US006558740B1

(12) United States Patent
Santo et al.

(10) Patent No.: US 6,558,740 B1
(45) Date of Patent: May 6, 2003

(54) PRINTING MEDIUM, PRODUCTION PROCESS THEREOF AND IMAGE-FORMING PROCESS USING THE MEDIUM

(75) Inventors: Tsuyoshi Santo, Yokohama (JP); Hiroyuki Sugata, Yamato (JP); Yuji Kondo, Machida (JP); Hiroshi Tomioka, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/330,319

(22) Filed: Jun. 11, 1999

Related U.S. Application Data

(62) Division of application No. 08/640,110, filed on Apr. 30, 1996, now Pat. No. 5,965,252.

(30) Foreign Application Priority Data

May 1, 1995 (JP) ..... 7-107456
Jul. 10, 1995 (JP) ..... 7-173619
Apr. 26, 1996 (JP) ..... 8-107570

(51) Int. Cl.[7] ..... B05D 5/04; B41M 5/00
(52) U.S. Cl. ..... 427/146; 427/150; 428/195
(58) Field of Search ..... 428/195, 329; 347/105; 427/146, 150

(56) References Cited

U.S. PATENT DOCUMENTS

| | | | | |
|---|---|---|---|---|
| 4,202,870 | A | 5/1980 | Weber et al. | 423/630 |
| 4,242,271 | A | 12/1980 | Weber et al. | 260/448 |
| 4,879,166 | A | 11/1989 | Misuda et al. | 428/212 |
| 5,104,730 | A | 4/1992 | Misuda et al. | 428/304.4 |
| 5,302,437 | A | 4/1994 | Idei et al. | 428/195 |
| 5,496,634 | A | 3/1996 | Ogawa et al. | 428/341 |
| 5,635,291 | A | 6/1997 | Yoshino et al. | 428/304.4 |
| 5,679,451 | A | 10/1997 | Kondo et al. | 428/304.4 |
| 5,707,716 | A | 1/1998 | Yoshino et al. | 428/212 |
| 5,738,932 | A | 4/1998 | Kondo et al. | 428/195 |
| 5,804,320 | A | 9/1998 | Tomioka et al. | 428/478.2 |
| 6,261,669 | B1 * | 7/2001 | Yang et al. | |

FOREIGN PATENT DOCUMENTS

| | | |
|---|---|---|
| EP | 0 649 752 | 4/1995 |
| JP | 54-59936 | 5/1979 |
| JP | 60-224578 | 11/1985 |
| JP | 60-224580 | 11/1985 |
| JP | 61-12388 | 1/1986 |
| JP | 62-178384 | 8/1987 |
| JP | 1-222985 | 9/1989 |
| JP | 2-276670 | 11/1990 |
| JP | 3-43290 | 2/1991 |
| JP | 3-268992 | 11/1991 |
| JP | 4-8579 | 1/1992 |
| JP | 4-37576 | 2/1992 |
| JP | 57-89954 | 6/1992 |
| JP | 5-32037 | 2/1993 |
| JP | 5-125437 | 5/1993 |
| JP | 5-125438 | 5/1993 |
| JP | 5-125439 | 5/1993 |
| JP | 6-114571 | 4/1994 |

OTHER PUBLICATIONS

Derwent Publications, Inc., AN 90–206788, (JP 02139275 of May 29, 1990).*
Database WPI, Derwent Publications Ltd., AN 90–380844, (with respect to JP 2–276670 of Nov. 13, 1990).
Database WPI, Derwent Publications Ltd., AN 88–238043, (with respect to JP 63–170081 of Jul. 13, 1988).
Databse WPI, Derwent Publications Ltd., AN 87–259745, (with respect to JP 62–178384 of Aug. 5, 1987).
Database WPI, Derwent Publications Ltd., AN 85–320762, (with respect to JP 60–224580 of Nov. 8, 1985).
Database WPI, Derwent Publications Ltd., AN 83–21223k, (with respect to JP 58–11191 of Jan. 21, 1983).

* cited by examiner

*Primary Examiner*—Pamela R. Schwartz
(74) *Attorney, Agent, or Firm*—Fitzpatrick, Cella, Harper & Scinto

(57) ABSTRACT

Disclosed herein is a printing medium comprising a substrate and an ink-receiving layer which comprises an alumina hydrate surface-treated with a coupling agent and is provided on the substrate.

16 Claims, 1 Drawing Sheet

PRINTING MEDIUM, PRODUCTION PROCESS THEREOF AND IMAGE-FORMING PROCESS USING THE MEDIUM

This is a divisional application of application Ser. No. 08/640,110, filed Apr. 30, 1996, now U.S. Pat. No. 5,965, 252.

BACKGROUND OF THE INVENTION

1. Field of the Invention

The present invention relates to a printing medium suitable for use in printing with water-based inks. In particular, the present invention relates to a printing medium, which can prevent the occurrence of beading and provide images high in optical density, bright in color tone and high in resolution, and has excellent ink-absorbing capacity.

The present invention also relates to a printing medium that has good surface hardness and film properties in addition to the above-described characteristics or properties.

The present invention further relates to a production process of the printing medium and an image-forming process using this medium.

2. Related Background Art

In recent years, an ink-jet recording system, in which minute droplets of an ink are flown by any one of various working principles to apply them to a printing medium such as paper, thereby making a record of images, characters and/or the like, has been quickly spread as a recording apparatus for various images in various applications including information instruments because it has features that printing can be conducted at high speed and with a low noise, color images can be formed with ease, printing patterns are very flexible, and development and fixing processes are unnecessary. Further, it begins to be applied to a field of recording of full-color images because images formed by a multi-color ink-jet system are comparable in quality with multi-color prints by a plate making system and photoprints by a color photographic system, and such printed images can be obtained at lower cost than the usual multi-color prints and photbprints when the number of copies is small. With the improvement in printability such as speeding up and high definition of printing, and full-coloring of images, printing apparatus and printing methods have been improved, and printing media have also been required to have higher properties.

In recent years, printing media having a coating layer, in which an alumina hydrate of a boehmite structure is used, have also been proposed and are disclosed in, for example, U.S. Pat. Nos. 4,879,166 and 5,104,730, and Japanese Patent Application Laid-Open Nos. 2-276670, 4-37576 and 5-32037.

The printing media using these alumina hydrates have advantages that since the alumina hydrates have a positive charge, a dye in an ink is well fixed, that since an ink-receiving layer comprising such an alumina hydrate has good transparency, an image high in optical density and good in coloring can be provided, that problems such as bronzing of a black ink and reduction of light fastness, which have heretofore been caused by the use of silica compounds, are not caused and moreover that they are better than the conventional printing media from the viewpoint of the quality and gloss of images formed thereon, in particular, full-color images, and application to sheets for OHP.

In order to have a printing medium fully exhibit the advantages inherent in these alumina hydrates, it is however necessary to improve the following respects:

1) Since the quantity of inks ejected on a printing medium is increased for coping with the demand for the provision of a high-quality image upon, in particular, full-color printing in recent years, the printing medium is required to have high ink absorbency. If the printing medium has poor ink absorbency, inks ejected are more than its ink-receiving layer can absorb in pores thereof and hence run out of the surface of the ink-receiving layer, so that there are involved problems that bleeding occurs to deteriorate print quality and color reproducibility, and that the fluid inks before fixing run and aggregate to cause beading (unevenness of printing).

The term "beading" as used herein refers to a phenomenon caused by the fact that droplets of inks applied to a printing medium aggregate into larger droplets in the course of absorption and/or the like. It is said that the beading is easy to occur on media low in ink absorbency or slow in fixing speed of a dye in an ink, or even on media having good ink absorbency when inks are applied in plenty.

In a printing medium provided with an ink-receiving layer, the beading is observed on the surface of the ink-receiving layer and also in the interior of the ink-receiving layer when it is transparent.

In order to solve such a problem of beading, it is disclosed in Japanese Patent Application Laid-Open No. 1-222985 to apply hydrophobic fine particles such as oil droplets or particles of a fluorocarbon resin to the surface of an ink-receiving layer.

According to this method, however, it is not easy to adjust the amount of the hydrophobic fine particles to be applied. If the amount thereof is too little, the effect of the application cannot be fully exhibited. If the amount is too great on the other hand, the ink absorbency of the resulting printing medium becomes deteriorated, and so it rather becomes easy to induce beading.

Besides, the effect of this method on the beading is limited to the surface of the ink-receiving layer and is scarcely exhibited on beading in the interior of the ink-receiving layer, which is caused by ink penetrated into the ink-receiving layer.

It is disclosed in Japanese Patent Application Laid-Open No. 60-224580 to use synthetic amorphous silica, the surface of which has been treated with a silane coupling agent, in an ink-receiving layer, thereby adjusting the degree of feathering of dots. It is also disclosed in Japanese Patent Application Laid-Open No. 62-178384 to use silica, the surface of which has been treated with a silane coupling agent, in an ink-receiving layer, thereby improving the light fastness of an image to be formed.

However, silica is large in size of secondary aggregate, and so a porous ink-receiving layer containing this silica has a mat and white coating surface. Therefore, such a sheet can be applied only to coated paper using paper as a substrate and not applied to a medium which can provide a high-gloss image like a photoprint, which meets the demand for formation of a high-quality image in recent years, or to a transparent sheet for OHP.

SUMMARY OF THE INVENTION

It is therefore an object of the present invention to provide a printing medium which has a transparent ink-receiving layer, can suppress occurrence of beading, can provide images high in optical density, good in resolution and bright in color tone, and has good ink absorbency, and an image-forming process using this printing medium.

Another object of the present invention is to provide a printing medium which causes no change in tint of an image formed thereon, has good color reproducibility, can provide images good in water fastness and weather fastness and scarcely causes curling, and an image-forming process using this printing medium.

A further object of the present invention is to provide a production process of a printing medium, by which margins for the preparation conditions, coating conditions and drying conditions of a coating dispersion can be made wide, the dispersion is stable and can be applied at high speed, and productivity is high.

The above object can be achieved by the present invention described below.

According to the present invention, there is thus provided a printing medium comprising a substrate and an ink-receiving layer which comprises an alumina hydrate surface-treated with a coupling agent and is provided on the substrate.

According to the present invention, there is also provided an image-forming process comprising ejecting droplets of inks from minute orifices to apply the ink droplets to a printing medium, thereby forming an image, wherein the printing medium described above is used as said printing medium.

According to the present invention, there is further provided a process for producing a printing medium comprising forming an ink-receiving layer on a substrate, wherein the ink-receiving layer is formed by applying a dispersion comprising an alumina hydrate surface-treated with a coupling agent in advance and a binder to the substrate and then drying the dispersion.

According to the present invention, there is still further provided a process for producing a printing medium comprising forming an ink-receiving layer on a substrate, wherein the ink-receiving layer is formed by applying a dispersion comprising a coupling agent or a hydrolyzate thereof, an alumina hydrate and a binder to the substrate and then drying the dispersion.

According to the present invention, there is yet still further provided a process for producing a printing medium comprising forming an ink-receiving layer on a substrate, wherein the ink-receiving layer is formed by applying a dispersion comprising an alumina hydrate surface-treated with a coupling agent in advance and a polymerizable compound to the substrate and then polymerizing the polymerizable compound.

DESCRIPTION OF THE PREFERRED EMBODIMENTS

Figure 1:
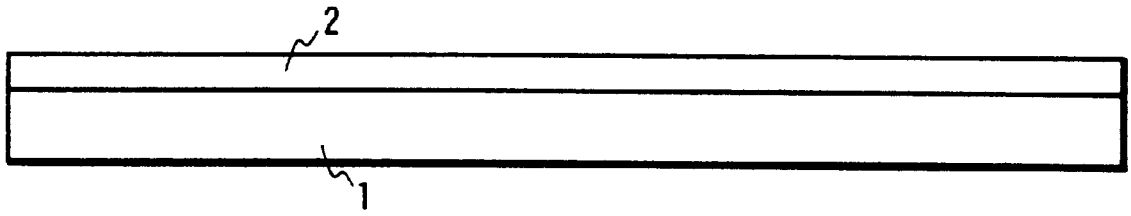
FIG. 1 is a cross-sectional view illustrating a printing medium according to an embodiment of the present invention.

Each of the printing media according to the present invention is constructed by forming an ink-receiving layer 2 composed principally of an alumina hydrate surface-treated with a coupling agent and a binder on a substrate 1 as illustrated in FIG. 1.

The alumina hydrate used in the present invention is represented by the general formula $$Al_2O_{3-n}(OH)_{2n}.mH_2O$$

wherein n is an integer of 0, 1, 2 or 3, m is a number of 0 to 10, preferably 0 to 5 provided that n and m are not both zero. In many cases, $mH_2O$ represents an aqueous phase which does not participate in the formation of a crystal lattice, but is able to be eliminated. Therefore, m may take a value other than an integer. Besides, m may take a value of 0 when a material of this kind is calcinated.

An alumina hydrate useful in the practice of the present invention is an alumina hydrate showing a boehmite structure or non-crystalline state as analyzed by the X-ray diffractiometry. In particular, an alumina hydrate described in Japanese Patent Application No. 5-125437, 5-125438, 5-125439 or 6-114571 may preferably be used. The alumina hydrate preferably has a boehmite structure or is an amorphous compound from the viewpoint of transparency, coloring ability and ink-fixing ability in particular. It is also preferable for the alumina hydrate to be an alumina hydrate in the form of a flat plate having an average aspect ratio of from 3 to 10.

The pore properties of the alumina hydrate are adjusted in the course of its production. In order to meet the BET specific surface area and pore volume required of the resulting ink-receiving layer, which will be described subsequently, it is preferable to use.an alumina hydrate the pore volume of which is within a range of from 0.1 to 1.0 ml/g. If the pore volume of the alumina hydrate is outside the above range, it is difficult to adjust the pore volume of the ink-receiving layer within the specified range.

With respect to the BET specific surface area, an alumina hydrate the BET specific surface area of which is within a range of from 40 to 500 $m^2/g$ is preferably used. If the BET specific surface area of the alumina hydrate is outside the above range, it is difficult to adjust the BET specific surface area of the ink-receiving layer within the specified range.

As the coupling agent used in the surface treatment of the alumina hydrate in the present invention, there may be used a silane, titanate, aluminum or zirconium coupling agent.

When the surface of the alumina hydrate is treated with the coupling agent, it is necessary for an organic group derived from the coupling agent to be bonded to the alumina hydrate through a metal, for example, Si, Ti, Al or Zr without being hydrolyzed. As preferable examples of these coupling agents, may be mentioned the following compounds.

The silane coupling agent is represented by the general formula $$R_pSiX_{4-p}$$

wherein R is a hydrocarbon group such as an alkyl, alkenyl or aryl group which may be substituted, X is a hydrolyzable group, and p is an integer of 1 to 3 with the proviso that when p is 2 or 3, R radicals may be identical with or different from each other. Examples of R include hydrocarbon groups having an alkyl, alkenyl, aryl, alkinyl, aralkyl, amino, diamino, epoxy, mercapto, glycidoxy, methacryloxy, ureido, chloro or cyano radical, or the like. Examples of X include hydrolyzable substituents selected from the group consisting of alkoxyl, alkoxyalkoxyl, halogen and acyloxy radicals, for example, methoxy, ethoxy and chloro radicals.

Specific examples of the silane coupling agent include dialkoxysilane compounds, diacyloxysilane compounds, trialkoxysilane compounds, triacyloxysilane compounds, triphenoxysilane compounds and hydrolyzates thereof, such as methyltrimethoxysilane, methyltriethoxysilane, methyltrichlorosilane, vinyltrichlorosilane, vinyltriacetoxysilane, vinyltris(β-methoxyethoxy)silane, vinyltriethoxysilane, vinyltrimethoxysilane, γ-methacryloxypropyltrimethoxysilane, γ-methacryloxypropylmethyldimethoxysilane, β-(3,4-epoxycyclohexyl)ethyltrimethoxysilane, γ-glycidoxypropyltrimethoxysilane, γ-glycidoxypropylmethyldiethoxysilane, N-β-(aminoethyl)-γ-aminopropyltrimethoxysilane, N-β-(aminoethyl)-γ-aminopropylmethyldimethoxysilane, γ-aminopropyltriethoxysilane, N-phenyl-γ-aminopropyltrimethoxysilane, γ-mercaptopropyltrimethoxysilane, γ-mercaptopropylmethyldimethoxysilane, γ-chloropropyltrimethoxysilane, γ-chloropropylmethyldichlorosilane, γ-chloropropylmethyldimethoxysilane, γ-chloropropylmethyldiethoxysilane, γ-ureidopropyltriethoxysilane, γ-anilinopropyltrimethoxysilane and octadecyldimethyl[3-(trimethoxysilyl)propyl]-ammonium chloride.

Besides, alkoxysilane compounds and hydrolyzates thereof, such as trimethylmethoxysilane, methyltrimethoxysilane, phenylethoxysilane and octadecyltriethoxysilane, chlorosilane compounds such as trimethylchlorosilane, methylvinylchlorosilane and phenyltrichlorosilane, silazanes and hydrolyzates thereof, such as hexamethyldisilazane, N-trimethylsilylacetoamide and trimethylsilylimidazole may also be preferably used in the surface treatment of the alumina hydrate.

Preferable examples of the titanate coupling agent include isopropyltriisostearoyl titanate, isopropyltri(N-aminoethyl-aminoethyl)titanate, isopropyltrioctanoyl titanate, isopropyldimethacrylisostearoyl titanate and isopropylisostearoyldiacryl titanate. Besides, there may be mentioned alkoxides and chelate compounds of titanium, and hydrolyzates thereof, such as isopropyltris(dioctyl pyrophosphate) titanate, tetraoctylbis(ditridecyl phosphite)titanate, tetra(2,2-diallyloxymethyl-1-butyl)bis(ditridecyl)phosphate titanate, bis(dioctyl pyrophosphate)oxyacetate titanate, bis(dioctyl pyrophosphate)ethylene titanate, isopropyltri(dioctyl phosphate)titanate, tetraisopropylbis(dioctyl phosphite) titanate, butyl titanate dimer, tetra(2-ethylhexyl) titanate, titanium acetylacetonate, poly(titanium acetylacetonate), titanium octylene glycolate, ammonium titanium lactate, ethyl titanium lactate, titanium triethanolaminate, poly(hydroxytitanium stearate) and titanium dipropoxybisacetylacetonate.

As examples of the aluminum coupling agent, may be mentioned alkoxides and chelate compounds of aluminum, and hydrolyzates thereof, such as acetoalkoxyaluminum diisopropionate, aluminum trisacetylacetonate, aluminum diisopropoxybisacetylacetonate, mono-sec-butoxyaluminum diisopropionate, aluminum triethoxide, aluminum triisopropoxide and aluminum tributoxide.

Examples of the zirconium coupling agent include alkoxides and chelate compounds of zirconium, and hydrolyzates thereof, such as zirconium acetylacetonate, acetylacetone zirconium butyrate, zirconium stearate butyrate, zirconium tetraacetylacetonate, zirconium dibutoxybisacetylacetonate, zirconium tributoxyacetylacetonate, zirconium tetrakisethyllactate and zirconium dibutoxybisethyllactate.

These coupling agents may be used either singly or in any combination thereof.

Although the amount of the coupling agent to be added varies according to the various properties of the aluminum hydrate and the kind of the coupling agent, the effect of the present invention can be brought about so far as the coupling agent is used in a proportion ranging from 0.1 to 30% by weight, preferably from 0.5 to 20% by weight, more preferably from 1 to 10% by weight based on the alumina hydrate. The most preferable amount of the coupling agent to be added is such an amount that a proportion of an area covered with the coupling agent by the surface treatment of the surface area of the alumina hydrate amounts to 0.1 to 30%, preferably 0.5 to 20%, more preferably 0.7 to 15%. More specifically, an amount a(g) of the coupling agent the monomolecular film of which covers the surface of the raw powder of the alumina hydrate by 100% is determined by the minimum area coverage of the coupling agent and the surface area of the alumina hydrate, namely, is calculated in accordance with the equation $$a\ (\mathrm{g}) = \frac{\{\text{Weight (g) of alumina hydrate}\} \times \{\text{Specific surface area } (\mathrm{m^2/g})\}}{\text{Minimum area coverage } (\mathrm{m^2/g}) \text{ of coupling agent}}.$$

Accordingly, the preferable amount of the coupling agent to be added in the present invention is expressed by 0.001a (g)≦the amount added (g)≦0.3a(g).

If the proportion of the area covered with the coupling agent by the surface treatment of the surface area of the alumina hydrate is lower than 0.1%, the effect of the coupling agent is not fully exhibited. If the proportion exceeds 30%, the ink absorbency, resolution and color reproducibility of the resulting printing medium, which are basic performance characteristics, are lowered though the stability of the dispersion and film performance are improved.

A quantitative ratio of the coupling agent to the alumina hydrate in the alumina hydrate powder surface-treated with the coupling agent, or a quantitative ratio of the coupling agent to the alumina hydrate in the ink-receiving layer formed using the surface-treated alumina hydrate is controlled by the amount of the coupling agent to be added so as to meet the above range as described above.

The quantitative ratio as to the coupling agents other than the aluminum coupling agents can also be defined as follows from the alumina hydrate treated with the coupling agent and the ink-receiving layer formed using this alumina hydrate.

The quantitative ratio of the coupling agent to the alumina hydrate in the alumina hydrate powder surface-treated with the coupling agent, or the quantitative ratio of the coupling agent to the alumina hydrate in the ink-receiving layer formed using the surface-treated alumina hydrate can be determined by a ratio of a peak height of a 2s electron of silicon, a 2s electron of titanium or a 3s electron of zirconium to a peak height of a 2s electron of aluminum by an X-ray photoelectron spectroscopy (XPS or ESCA, hereinafter referred to as ESCA collectively).

Namely, the content of the coupling agent can be determined by a ratio of number of atoms Si(2s)/Al(2s), Ti(2s)/Al(2s) or Zr(3s)/Al(2s).

In the measurement by ESCA, these peaks are considered to be attributable to the atoms present in the uppermost layer to a depth of about 10.0 nm of a sample.

The ratio of number of atoms is found from a ratio of values obtained by dividing the peak areas of peaks of the respective photoelectron spectra by their corresponding relative intensity (C(1s)=1) of the peaks in accordance with the equation Si(2s)/Al(2s)={Peak area of Si(2s)/0.955}/{Peak area of Al(2s)/0.753}, Ti(2s)/Al(2s)={Peak area of Ti(2s)/3.24}/{Peak area of Al(2s)/0.753}, or Zr(3s)/Al(2s)={Peak area of Zr(3s)/1.7}/{Peak area of Al(2s)/0.753}.

At this time, as the relative intensity of the peaks of the respective photoelectron spectra, there are used values described in J. H. Scofield, J. Electron Spectrosc., 8, 129 (1976).

Excitation source: Al Kα ray, C(1s)=1
Al(2s)=0.753, Si(2s)=0.955, Ti(2s)=3.24,
Zr(3s)=1.7.

In the present invention, it is desirable that the ratio of number of atoms found in the above-described manner be within a range of from 0.003 to 0.3. If the ratio is lower than 0.003, the effect of the surface treatment with the coupling agent can not be fully exhibited. If the ratio exceeds 0.3, the ink absorbency, resolution and color reproducibility of the resulting printing medium become liable to be lowered though the stability of the dispersion and film performance are improved.

In the present invention, when the hydrophilic surface of the alumina hydrate is made partially hydrophobic by using the coupling agent, there is brought about an effect of preventing the occurrence of beading, particularly, in the interior of the ink-receiving layer.

Among the above-described coupling agents, the silane coupling agents are particularly preferred in that they have adequate reactivity (when the coupling agent is rapidly reacted, it undergoes polymerization (gelling) by itself) at pH 3 to 5 in which the alumina hydrate is stably dispersed, and that the degree of hydrophobicity is easy to be adjusted of the silane coupling agents, those having a hydrocarbon group which has, as R, an alkyl group such as a methyl, ethyl or isopropyl group, an alkenyl group such as a vinyl, 1-propenyl, allyl, isopropenyl or butenyl group, an aryl group such as a phenyl or tolyl group, an alkynyl group such as a propargyl, butynyl or pentynyl group, or an aralkyl group such as a benzyl or p-methylbenzyl group are particularly preferred in that adequate hydrophobicity can be imparted.

Processes for the treatment with the coupling agent of the surface of the alumina hydrate in the present invention are described in detail in catalogs of coupling agent makers (Nippon Unicar Co., Ltd., Toshiba Silicone Co., Ltd., Shin-Etsu Silicone Co., Ltd., and Ajinomoto Co., Inc.), technical materials and the like, and are roughly divided into three processes, (1) a dry process, (2) a wet process and (3) a spray process.

The dry process (1) is a process in which alumina hydrate powder is charged into a commercially-available mixer such as a Henschel mixer, Super mixer or V blender, and an aqueous solution (or a solution diluted with a solvent or a stock solution) of a coupling agent is then added into the powder by spraying or drop addition while fully stirring the powder.

The wet process (2) is a process in which an alumina hydrate is dispersed in a medium such as water, the dispersion is stirred at a high speed into a slurry, a solution of a coupling agent is then added to the slurry, and the thus-treated alumina hydrate is then dried.

The spray process (3) is a process in which an aqueous solution of a coupling agent is added to an alumina hydrate kept at a high temperature by spraying.

An integral blending process (in-process treatment) (4) in which a surface treatment with a coupling agent is conducted at the same time as the mixing of a binder with an alumina hydrate, which will be described subsequently, may also be used.

By each of these processes, an alumina hydrate surface-treated with the coupling agent in the desired covering proportion may be obtained. However, a process in which the surface treatment is conducted in accordance with the wet process (2) while hydrolyzing the coupling agent in an aqueous system is preferred because the treatment can be evenly performed.

This wet process (2) will be described more specifically. Alumina hydrate powder is added to a coupling agent and water, an organic solvent such as methanol, ethanol or butanol, or a mixture of water and these organic solvents and then suspended by means of a homomixer, agitator, wet ball mill, ultrasonic disperser, HEIDON three-one motor (trade name, product of Shinto Scientific Co., Ltd.) or the like. An acid catalyst such as an inorganic acid may be added if necessary.

The suspension may be heated at a temperature lower than the boiling point or-decomposition point of the coupling agent depending upon the conditions for facilitating the surface treatment with the coupling agent. This temperature varies according to the kind of the coupling agent used. However, it is generally within a range of from 20 to 200° C., and the heating time is within a range of from 0.1 to 6 hours.

The drying of the alumina hydrate after it is suspended, or removal of the solvent is carried out by heat evacuation using a rotary evaporator or the like at a temperature ranging from 20 to 200° C., or fractionating or filtering a supernatant of the suspension. Further, the alumina hydrate may be dried by heat-treating the resultant alumina hydrate slurry by means of a temperature programming dryer or evaporator at a temperature ranging from 20 to 300° C. or spray-drying it by means of a spray dryer. It may be dried by heating under vacuum.

The heating temperature upon the surface treatment of the alumina hydrate with the coupling agent is preferably within a range of from 40 to 200° C., more preferably from 80 to 150° C. Besides, the heating time varies depending upon the heating temperature and throughput, but is generally within a range of from 0.5 to 12 hours, preferably from 1 to 6 hours.

When water is used as a dispersion medium in a coating formulation for the formation of an ink-receiving layer, the use of a dispersion comprising a coupling agent, an alumina hydrate and a binder as the coating formulation is preferred to the use of the alumina hydrate powder surface-treated with the coupling agent in that the process is simplified.

In order to control the dissolution and-hydrolysis of the coupling agent and the reactivity thereof, a polar organic solvent such as methanol, ethanol, isopropyl alcohol (IPA), n-butanol, acetone, methyl ethyl ketone (MEK), diacetone alcohol, methyl cellosolve, ethyl cellosolve, dimethylformamide (DMF) or dimethyl sulfoxide (DMSO), or an acid catalyst such as formic acid, acetic acid, nitric acid or hydrochloric acid may be added to the aqueous dispersion. DMF, methyl cellosolve, ethyl cellosolve and DMSO are particularly preferred because they have good dissolving ability for the coupling agent. It is also recognized that the ink absorbency and ink-absorbing rate of the ink-receiving layer are improved though the reason for it is unknown. It is hence preferable to add such a solvent.

Besides the alumina hydrate surface-treated with the coupling agent, the following pigments may be mixed for use. These pigments are also preferably surface-treated with the coupling agent. However, untreated pigments may also be used so far as the amount to be used is 50% by weight or less of the total weight of the pigments used. If the amount is more than 50% by weight, the effect according to the present invention can not be expected.

Examples of the pigments usable in the printing media according to the present invention include inorganic pigments such as calcium carbonate, kaolin, talc, calcium sulfate, barium sulfate, titania, zinc oxide, zinc carbonate, aluminum silicate, alumina, silicic acid, sodium silicate, magnesium silicate, calcium silicate and silica, organic pigments such as plastic pigments and urea resin pigments, and mixtures thereof.

Examples of the binder used in combination with the alumina hydrate in the printing media according to the present invention include cellulose esters such as nitrocellulose, cellulose phosphate, cellulose sulfate, cellulose acetate, cellulose propionate, cellulose butyrate, cellulose myristate, cellulose palmitate, cellulose acetate propionate and cellulose acetate butyrate; cellulose ethers such as methylcellulose, ethylcellulose, propylcellulose and butylcellulose; vinyl polymers such as polystyrene, polyvinyl chloride, polyvinyl acetate, polyvinyl butyral, polyvinyl formal, polyvinyl acetal, polyvinyl alcohol and polyvinyl pyrrolidone; copolymers such as styrene-butadiene copolymers, styrene-acrylonitrile copolymers, styrenebutadiene-acrylonitrile copolymers and vinyl chloridevinyl acetate copolymers; acrylic polymers such as polymethyl methacrylate, polymethyl acrylate, polybutyl acrylate, polyacrylic acid, polymethacrylic acid, polyacrylamide and polyacrylonitrile; polyesters such as polyethylene terephthalate; polycarbonate polymers such as poly(4,4-isopropylidenediphenylene-co-1,4-cyclohexylenedimethylenecarbonate), poly(ethylenedioxy-3,3'-phenylenethiocarbonate), poly(4,4'-isopropylidenediphenylenecarbonate), poly(4,4'-sec-butylidenediphenylenecarbonate) and poly(4,4'-isopropylidenediphenylenecarbonate-block-oxyethylene); polyamides and polyimides; epoxy polymers; phenolic polymers; polyolefins such as polyethylene, polypropylene and chlorinated polyethylene; and other natural or synthetic resins such as gelatin. Of these, vinyl polymers such as polyvinyl butyral, polyvinyl formal and polyvinyl acetal, and vinyl copolymers such as vinyl chloride-vinyl acetate copolymers are particularly preferred.

The ink-receiving layer provided on the printing medium according to the present invention is preferably formed in such a manner that the total pore volume thereof falls within a range of from 0.1 to 1.0 ml/g. If the pore volume of the ink-receiving layer is greater than the upper limit of the above range, cracking and dusting tends to occur on the ink-receiving layer. If the pore volume is smaller than the lower limit of the above range, the resulting printing medium is deteriorated in ink absorption, so that when multi-color printing is conducted on such a printing medium in particular, inks run out of the ink-receiving layer, and bleeding hence tends to occur on an image formed thereof.

The BET specific surface area of the ink-receiving layer is preferably within a range of from 20 to 450 $m^2/g$. If the BET specific surface area is smaller than the lower limit of the above range, the resulting ink-receiving layer becomes lowered in gloss, and its haze degree increases, so that an image formed thereon tends to wear a white haze. If the BET specific surface area is greater than the upper limit of the above range, the resulting ink-receiving layer becomes easy to cause cracking.

The BET specific surface area and pore volume can be determined by the nitrogen adsorption and desorption method after subjecting the ink-receiving layer to deaeration at 120° C. for 24 hours.

Since the alumina hydrate is surface-treated with the coupling agent such as silane in advance, which is a feature of the present invention, water-dispersible pigments can be used even in an organic system (a system containing an organic solvent and a binder), and there are thus brought about such effects that the defoaming ability and stability of the dispersion are improved compared with an aqueous system, and high-speed coating becomes feasible.

When an aqueous system is used from the viewpoint of ecology, any of the following water-soluble polymers may preferably be used as a binder used in combination with the alumina hydrate. Preferable examples thereof include polyvinyl alcohol or modified products thereof (cationically modified, anionically modified, silanol modified), starch or modified products thereof (oxidized, etherified), gelatin or modified products thereof, casein or modified products thereof, gum arabic, cellulose derivatives such as carboxymethylcellulose, hydroxyethylcellulose and hydroxypropylmethylcellulose, conjugated diene copolymer latexes such as SBR latexes, NBR latexes and methyl methacrylate-butadiene copolymers, functional group-modified polymer latexes, vinyl copolymer latexes such as ethylene-vinyl acetate copolymers, polyvinyl pyrrolidone, maleic anhydride polymer or copolymers thereof, acrylic ester copolymers, acrylamide resins and the like. These binders may be used either singly or in any combination thereof.

A hardener may also be used in combination in the dispersion containing the alumina hydrate and the water-soluble binder. This combined use permits the improvement of water resistance of the resulting ink-receiving layer.

Examples of such a hardener include water-soluble polyisocyanate compounds (for example, Mitec SW200, trade name; product of Mitsubishi Chemical Co, Ltd.), water-soluble aziridine compounds (for example, Chemitight DZ-22E and PZ-33, both, trade names; products of Nippon Shokubai Kagaku Kogyo Co., Ltd.), water-soluble melamine resins (for example, SUMIREZ RESIN 613 Special, 8% AC, EU, and SUMIMAL M-50W, M-30W and MC-1, all, trade names; products of Sumitomo Chemical Co., Ltd.), water-soluble urea resins (for example, Cymel 60 and 80, both, trade names; products of Mitsui Cyanamid Co., Inc.; and SUMIREZ RESIN 614 Special and 633, both, trade names; products of Sumitomo Chemical Co., Ltd.), water-soluble oxazoline compounds (for example, oxazoline reactive polymer, K-1020E, trade name; product of Nippon Shokubai Kagaku Kogyo Co., Ltd.) and the like.

The amount of the hardener to be used is about 5 to 40% by weight based on solids of the water-soluble binder. Viewed from the whole aqueous dispersion, the hardener is considered a part of the binder.

The mixing ratio of the alumina hydrate to the binder may be optionally selected from a range of from 1:1 to 30:1, preferably from 5:1 to 25:1 so far as the BET specific surface area and pore volume of the resulting ink-receiving layer satisfy the above ranges, respectively.

If the amount of the binder is less than the lower limit of the above range, the mechanical strength of the resulting ink-receiving layer becomes insufficient, which forms the cause of cracking and dusting. If the amount is greater than the upper limit of the above range, the pore volume of the resulting ink-receiving layer is reduced, resulting in a recording medium poor in ink absorbency.

Examples of the organic solvent used for the dispersion comprising the alumina hydrate and the binder include alcohols such as methanol, ethanol and isopropanol; ketones such as acetone, methyl ethyl ketone, cyclohexanone and diacetone alcohol; amides such as N,N-dimethylformamide and N,N-dimethylacetamide; sulfoxides such as dimethyl sulfoxide; ethers such as tetrahydrofuran, dioxane and ethylene glycol monomethyl ether; esters such as methyl acetate, ethyl acetate and butyl acetate; aliphatic halogenated hydrocarbons such as chloroform, methylene chloride, dichloroethylene, carbon tetrachloride and trichloroethylene; aromatics such as benzene, toluene, xylene, monochlorobenzene and dichlorobenzene; aliphatic or alicyclic hydrocarbons such as n-hexane, cyclohexane and ligroin; and fluorine-containing solvents such as tetrafluoropropanol and pentafluoropropanol. These solvents may be used either singly or in any combination thereof.

To the dispersion comprising the alumina hydrate and the binder, as needed, there may be added a dispersant, thickener, pH adjustor, lubricant, flowability modifier, surfactant, antifoaming agent, water-proofing agent, foam suppressor, releasing agent, foaming agent, penetrant, coloring dye, optical whitening agent, ultraviolet absorbent, antioxidant, antiseptic and mildewproofing agent.

The water-proofing agent may be freely selected for use from the known substances such as quaternary ammonium halides and quaternary ammonium salt polymers.

In a process for dispersing, there may be suitably used any apparatus routinely used in dispersion, such as a homomixer, high-speed and strong-shear disperser, ball mill, sand grinder, attritor, colloid mill, ultrasonic disperser or pressure homogenizer.

As a substrate for supporting the ink-receiving layer of the printing medium according to the present invention, paper such as suitably sized paper, water leaf paper or resin-coated paper, a sheet-like substance such as a thermoplastic film, or cloth may be used. No particular limitation is imposed on the substrate.

In the case of the thermoplastic film, there may be used a transparent film such as a film of polyester, polystyrene, polyvinyl chloride, polymethyl methacrylate, cellulose acetate, polyethylene or polycarbonate, or an opaque sheet opacified by the filling of an alumina hydrate, titanium white or the like or the formation of minute foams.

When the resin-coated paper is used as the substrate, the printing medium according to the present invention can be provided as a printing medium having the same feeling to the touch, stiffness and texture as those of a usual photoprint. Further, the printing medium according to the present invention becomes very close to the usual photoprint because its ink-receiving layer has high gloss.

The substrate may be subjected to a surface treatment such as a corona discharge treatment or flame treatment for improving its adhesiveness to the ink-receiving layer, or provided with an easy-adhesion layer as an under coat. Further, a curl-preventing layer such as a resin layer or a pigment layer for preventing curling and/or a writable layer may be provided on the back surface (a side opposite to a side on which the ink-receiving layer is provided) of the substrate or at a desired position thereof.

The ink-receiving layer is formed by applying a dispersion comprising the alumina hydrate and the binder onto the substrate by means of a coater and then drying the dispersion. As a coating process, a blade coating system, air-knife coating system, roll coating system, brush coating system, gravure coating system, kiss coating system, extrusion system, slide hopper (slide bead) system, curtain coating system, spray coating system or the like may be used. The drying of the dispersion applied may be carried out by means of any of various driers, for example, hot air dryers such as a direct tunnel drier, arch dryer, air loop dryer and sine curve air float dryer, infrared dryers, and dryers making good use of microwaves or the like.

The coating weight of the dispersion is within a range of from 0.5 to 60 g/m$^2$, preferably from 5 to 45 g/m$^2$ in terms of dry solids content. In order to provide good ink absorbency and resolution, it is necessary to control the thickness of the ink-receiving layer to at least 15 $\mu$m, preferably at least 20 $\mu$m, particularly at least 25 $\mu$m.

According to another embodiment of the present invention, a polymerizable compound is used as the binder, thereby enhancing the hardness of the resulting ink-receiving layer.

As the polymerizable compound used in the present invention, there may be used a compound having at least one reactive vinyl group in its molecule. For example, one or more compounds may be selected for use from the group consisting of reactive vinyl group-containing monomers, reactive vinyl group-containing oligomers and reactive vinyl group-containing polymers.

Examples of the reactive vinyl group in the polymerizable compound include substituted or unsubstituted vinyl groups having polymerization reactivity, such as styrene type vinyl groups, acrylic acid type vinyl groups, methacrylic acid type vinyl groups, allyl type vinyl groups, and ester type vinyl groups as in vinyl ether and vinyl acetate.

Preferable specific examples of these compounds include monovalent monomers such as styrene, methyl styrene, chlorostyrene, bromostyrene, methoxystyrene, dimethylaminostyrene, cyanostyrene, nitrostyrene, hydroxystyrene, aminostyrene, carboxystyrene, acrylic acid, methyl acrylate, ethyl acrylate, cyclohexyl acrylate, acrylamide, methacrylic acid, methyl methacrylate, ethyl methacrylate, propyl methacrylate, butyl methacrylate, phenyl methacrylate, cyclohexyl methacrylate, vinylpyridine, N-vinyl-pyrrolidone, N-vinylimidazole, 2-vinylimidazole, N-methyl-2-vinylimidazole, propyl vinyl ether, butyl vinyl ether, isobutyl vinyl ether, β-chloroethyl vinyl ether, phenyl vinyl ether, p-methylphenyl vinyl ether and p-chlorophenyl vinyl ether; divalent monomers such as divinyl benzene, distyryl oxalate, distyryl malonate, distyryl succinate, distyryl glutarate, distyryl adipate, distyryl maleate, distyryl fumarate, distyryl β,β-dimethylglutarate, distyryl 2-bromoglutarate, distyryl α,α'-dichloroglutarate, distyryl terephthalate, diacryloxyethyl oxalate, diacryloxyisopropyl oxalate, diacryloxyethyl malonate, diacryloxyisopropyl malonate, diacryloxyethyl succinate, diacryloxyethyl glutarate, diacryloxyethyl adipate, diacryloxyethyl maleate, diacryloxyethyl fumarate, diacryloxyethyl β,β-dimethylglutarate, ethylene diacrylamide, propylene diacrylamide, 1,4-phenylene diacrylamide, 1,4-phenylenebis(oxyethyl acrylate), 1,4-phenylenebis(oxymethylethyl acrylate), 1,4-bis-(acryloyloxyethoxy)cyclohexane, 1,4-bis-(acryloyloxyethoxycarbamoyl)benzene, 1,4-bis (acryloyloxymethylethoxycarbamoyl)benzene, 1,4-bis (acryloyloxyethoxycarbamoyl)cyclohexane, bis (acryloyloxyethoxycarbamoylcyclohexyl)methane, dimethacryloxyethyl oxalate, dimethacryloxyisopropyl oxalate, dimethacryloxyethyl malonate, dimethacryloxyethyl succinate, dimethacryloxyisopropyl succinate, dimethacryloxyethyl glutarate, dimethacryloxyethyl adipate, dimethacryloxyethyl maleate, dimethacryloxyethyl fumarate, dimethacryloxyisopropyl fumarate, dimethacryloxyethyl β,β'-dimethylglutarate, 1,4-phenylenebis (oxyethyl methacrylate), 1,4-bis-(methacryloyloxyethoxy) cyclohexane and acryloyloxyethoxyethyl vinyl ether; trivalent monomers such as pentaerythritol triacrylate, pentaerythoritol trimethacrylate, pentaerythritol tri (hydroxystyrene), cyanuric acid triacrylate, cyanuric acid trimethacrylate, 1,1,1-trimethylolpropane triacrylate, 1,1,1-trimethylolpropane trimethacrylate, triacryloxyethyl cyanurate, 1,1,1-trimethylolpropane tri(ethyl acrylate), tri (ethyl vinyl ether) cyanurate, a condensate of a reaction product of 1,1,1-trimethylolpropane and 3 moles of toluene diisocyanate with hydroxy-ethyl acrylate, and a condensate of a reaction product of 1,1,1-trimethylolpropane and 3 moles of hexane diisocyanate with p-hydroxystyrene; tetravalent monomers such as ethylene tetraacrylamide, propylene tetra-acrylamide and pentaerythritol tetraacrylate; pentavalent monomers such as dipentaerythritol monohydroxypentaacrylate; hexavalent monomers such as dipentaerythritol hexaacrylate; polymerizable compounds consisting of an oligomer or polymer on the terminal of which a reactive vinyl group is left; and polymerizable compounds consisting of an oligomer or polymer to the side chain(s) of which a reactive vinyl group is added. These compounds may be used either singly or in any combination thereof.

In the present invention, the polymerizable compounds include the above-described reactive vinyl group-containing oligomers and reactive vinyl group-containing polymers in addition to the monomers having neither film-forming properties nor binding ability. Of these oligomers and polymers, those (hereinafter referred to as the polymerizable binder) having functions of film-forming properties and binding ability prior to their polymerization together with polymerizability are preferably used as the polymerizable compounds according to the present invention.

The film-forming properties as used herein mean that when the polymerizable binder is dissolved in a solvent and applied to the substrate, or the polymerizable binder is melted and extrusion-coated on the substrate, a lamellar film is formed.

The use of the polymerizable binder in the present invention is preferred to the case where a polymerizable compound having neither film-forming properties nor binding ability is used, in that:

(1) the resulting ink-receiving layer scarcely causes cure shrinkage, and the resulting printing medium becomes hard to curl;

(2) polymerization rate becomes fast because polymerizable functional groups can be added in plenty;

(3) since the molecular weight of a polymer formed by the polymerization is high, the resulting ink-receiving layer becomes hard to crack; and (4) since an oligomer or polymer constructs a main chain part, the resulting ink-receiving layer is flexible and hence high in flexural strength.

In the polymerizable binder used in the present invention, the polymerizable functional groups may be bonded to the terminals or side chains of the oligomer or polymer, which is a main chain of the polymerizable binder, as described above. However, the polymerizable binder may preferably have functional groups bonded to both terminals and side chains. The polymerizable binder preferably has at least 3 polymerizable functional groups in its molecule. The number of the polymerizable functional groups [groups/molecule] is preferably at most 1,000 [groups/molecule]. The number of the polymerizable functional groups contained in the polymerizable binder is preferably within a range of from 10 to 700 [groups/molecule], particularly from 20 to 500 [groups/molecule].

Measurement of the Number [Groups/molecule] of Polymerizable Functional Groups (Reactive Vinyl Groups)

The measurement of the number of reactive vinyl groups in the polymerizable binder may be carried out by any known method. In the present invention, the number is determined in accordance with the iodine value measuring method by Hubl. An illustrative measuring method using this method will hereinafter be described.

In 1-liter flask, 1.0 g of a polymerizable binder sample is weighed, to which 10 ml of chloroform are added to dissolve the sample therein. To the solution, 25 ml of a solution of iodine (a solution obtained by dissolving 25 g of iodine in 500 ml of 95% alcohol, dissolving 30 g of silver chloride in 500 ml of alcohol and mixing these solutions in equal amounts 24 hours prior to use) are added. The mixture is fully shaken and left to stand for 12 hours in a dark place. At the same time, the same operation as described above except that the polymerizable binder sample is omitted is carried out as a blank in another flask.

After 12 hours, 20 ml of a solution (10%) of potassium iodide and 500 ml of distilled water are added to both flasks, and the flasks are fully shaken, followed by titration with a 0.1N solution of $Na_2S_2O_3$. The iodine absorption of the polymerizable binder sample is determined by subtracting the consumption of the 0.1N $Na_2S_2O_3$ solution in the flask of the blank from the consumption in the flask containing the polymerizable binder sample. Here, the iodine value is determined in accordance with the equation $$\text{Iodine value} = 0.127 \times V \times N \times 100/W \quad \text{(a)}$$

wherein V is the consumption of the 0.1N $Na_2S_2O_3$ solution in the flask containing the polymerizable binder sample, N is a normality of the $Na_2S_2O_3$ solution, and W is a weight (g) of the polymerizable binder sample. Besides, the theoretical iodine value per double bond is determined by the equation $$254 \times 100/M \quad \text{(b)}$$

wherein M is a number average molecular weight of the polymerizable binder sample. The number of double bonds, i.e., reactive vinyl groups, per molecule is determined by [the found iodine value (a)]/[the theoretical iodine value (b)].

In order for the polymerizable binder used in the present invention to keep the ink-receiving layer lamellar, the polymerizable binder itself preferably has tensile strength of from 1 to 1,000 kg/cm$^2$, more preferably from 10 to 800 kg/cm$^2$ as measured in accordance with ASTM D 638.

The measuring method of ASTM D 638 is as follows:

A polymerizable binder sample is dissolved in a suitable solvent such as methyl ethyl ketone or ethanol, or heated and melted to form a plate having a thickness of 6 mm or thinner. Thereafter, a test piece of the size of Shape II is formed from the plate in accordance with the standard of ASTM D 638. This test piece is then stretched at a rate B (0.50 inch/min) to determine its strength at this time.

The polymerizable binder is prepared by any of, for example, the following combinations:

(1) a polymerizable binder obtained by reacting an oligomer or polymer having a carboxyl group with a monomer having at least one of hydroxyl, amino, glycidyl and isocyanate groups and further having a double bond;

(2) a polymerizable binder obtained by reacting an oligomer or polymer having a hydroxyl group with a monomer having at least one of carboxyl, isocyanate and glycidyl groups and further having a double bond;

(3) a polymerizable binder obtained by reacting an oligomer or polymer having an isocyanate group with a monomer having at least one of carboxyl, hydroxyl and amino groups and further having a double bond;

(4) a polymerizable binder obtained by reacting an oligomer or polymer having a glycidyl group with a monomer having at least one of hydroxyl, amino and carboxyl groups and further having a double bond; and (5) a polymerizable binder obtained by reacting an oligomer or polymer having an amino group with a monomer having at least one of glycidyl, isocyanate and carboxyl groups and further having a double bond.

Specific examples of the polymer or oligomer, which constructs the main chain of the polymerizable binder, include homopolyners of acrylic acid, methacrylic acid and maleic anhydride, or copolymers of monomers, which construct these homopolymers, with an acrylic monomer or a styrene type monomer; homopolymers such as polyvinyl alcohol, polyvinyl acetal, polyvinyl butyral, cellulose and derivatives thereof, phenolics, poly(hydroxyethyl acrylate) and poly(hydroxyethyl methacrylate), or copolymers of monomers, which construct these homopolymers, with an acrylic monomer or a styrene type monomer; saturated polyester, poly(methylene diisocyanate), polyurethane resins having an isocyanate group, epibis type epoxy resins, novolak type epoxy resins and a homopolymer of glycidyl methacrylate, or copolymers of monomers, which construct these homopolymers, with an acrylic monomer or a styrene type monomer; and polyallylamine and polyamide.

Examples of the monomer used for introducing a double bond into the above polymers or oligomers include hydroxyethyl acrylate, hydroxypropyl acrylate, hydroxyethyl methacrylate, hydroxypropyl methacrylate, butanediol monoacrylate, diacrylated isocyanurate, glycerol acrylate, glycerol diacrylate, glycerol methacrylate, glycerol dimethacrylate, pentaerythritol triacrylate, pentaerythritol diacrylate, polyethylene glycol methacrylate, polypropylene glycol methacrylate, glycyl acrylate, acrylic acid, methacrylic acid, phthalic acid diacrylate, phthalic acid dimethacrylate, succinic acid diacrylate and isocyanate ethyl methacrylate.

Preferable examples of the polymerizable binders prepared by the combinations (1) to (5) are mentioned below.

A polymerizable binder having the following structural formula (a) is prepared from partially saponified polyvinyl alcohol and acrylic acid.

(a)

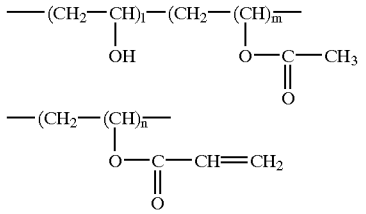

A polymerizable binder having the following structural formula (b) is prepared from polyvinyl butyral and acrylic acid.

(b)

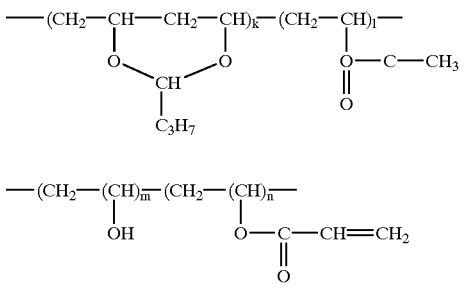

A polymerizable binder having the following structural formula (c) is prepared from a maleic anhydride type polymer and hydroxyethyl acrylate.

(c)

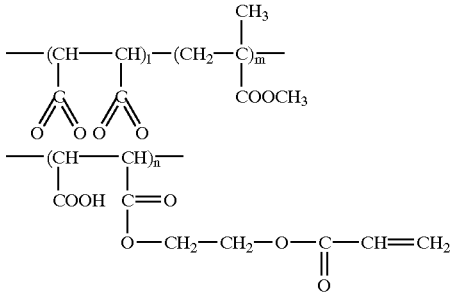

A polymerizable binder having the following structural formula (d) is prepared from a bisphenol A type epoxy resin and acrylic acid.

(d)

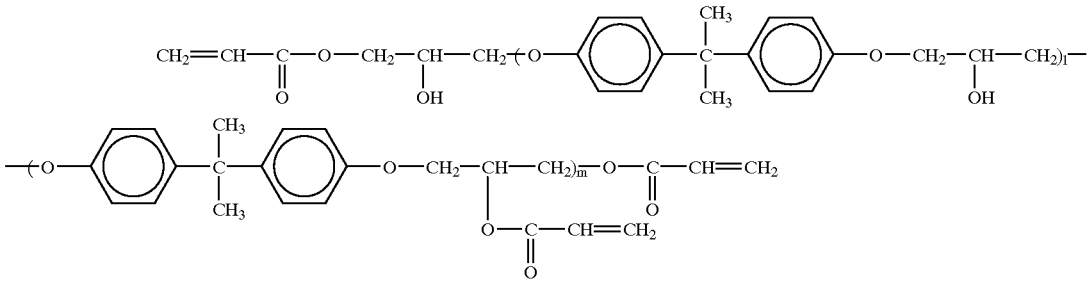

A polymerizable binder having the following structural formula (e) is prepared from a novolak type epoxy resin and acryloyl chloride.

(e)

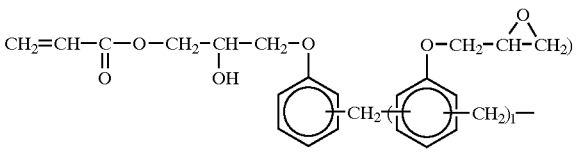

-continued

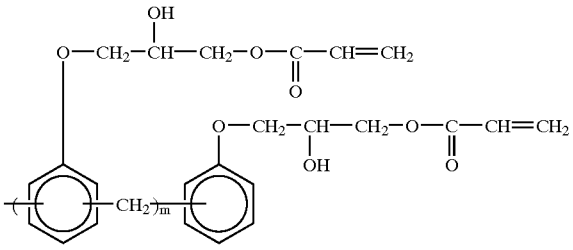

A polymerizable binder having the following structural formula (f) is prepared from an acrylic resin and glycidyl acrylate.

(f)

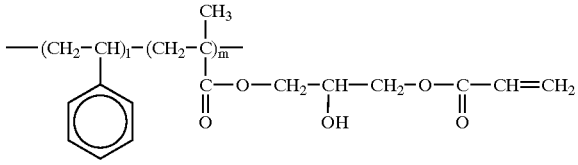

Among the polymerizable binders of the formulae (a) to (f), the binders of the formulae (a) to (c) and (f) are preferably used from the view point of pigment dispersibility. It is more preferable to use the binder of the formula (b) in that it is easy to be synthesized, and its raw materials are cheap and easily available.

If the molecular weight of the polymer or oligomer, which constructs the main chain of the polymerizable binder, is too high, a phenomenon that the movement of the binder molecule is lowered upon polymerization, and its reactivity is reduced occurs. However, since the polymerizable binder according to the present invention is also required to have film-forming properties, the molecular weight of the polymerizable binder is desirably within a range of from 5,000 to 1,000,000, more preferably from 10,000 to 600,000.

In the present invention, the molecular weight of the polymerizable binder is determined by using a calibration curve prepared using polystyrene as a standard sample in accordance with GPC (gel permeation chromatography).

Besides, the glass transition temperature of the polymerizable binder is desirably −30° C. or higher, more preferably 0° C. or higher.

Unreacted monomer, oligomer and polymer may remain in the polymerizable binder.

In the present invention, polymerizable binders described in "Kino Zairyo (Functional Materials)" (edited and published by CMC K.K., the December 1983 issue, pp. 48), and the like may also be used.

The polymerizable binder may be used in combination with the polymerizable compound having neither film-forming properties nor binding ability, such as the reactive vinyl group-containing monomer.

A feature of the present invention is to use this polymerizable compound (the polymerizable binder) to form an ink-receiving layer. The above-mentioned various problems can be solved by using this polymerizable compound.

When the film properties of the ink-receiving layer are improved to enhance its surface hardness, there is a method in which a binder having a high molecular weight is used. In this method, however, the viscosity of a dispersion increases, and so difficulty is encountered on coating of the dispersion. Since the polymerizable compound increases its molecular weight upon its polymerization, it is unnecessary to mix a polymerizable compound having a high molecular weight into a dispersion. It may have a rather low molecular weight, and any low-molecular weight polymerizable compound may be used so far as it can become a high-molecular weight binder upon its polymerization, exhibits good film-forming properties and binding ability and enhances the surface hardness of the resulting ink-receiving layer.

It goes without saying that the use of this low-molecular weight polymerizable compound makes it possible to stabilize the dispersion at a low viscosity, whereby suitability for coating of the dispersion can be improved. It is also possible to make the dispersion solventless.

In the present invention, it is an important and great feature that the alumina hydrate is surface-treated with the coupling agent in advance. This feature makes it possible to mix the alumina hydrate with the polymerizable compound. Further, it is also possible to disperse the alumina hydrate in an organic solvent which will be described subsequently.

A photo-induced polymerization initiator and/or a heat-induced polymerization initiator may be used for polymerizing the polymerizable compound.

Any known initiator may be used as the heat-induced polymerization initiator. Examples thereof include azo initiators and peroxide initiators. The azo initiator is an organic compound having at least one nitrogen-nitrogen double bond in its molecule. Examples thereof include azobisisobutyronitrile, azobisvaleronitrile, azobispropionitrile, azobiscyclohexanecarbonitrile, azobismethylphenetylcarbonitrile, azobis-sec-amylonitrile, azobisphenylethane, azobiscyclohexylpropionitrile, azobismethylchloroethane, diazoaminobenzene, tritylazobenzene, phenylazoisobutyronitrile, 9-(p-nitrophenylazo)-9-phenylfluorene, nitrosoacylallylamines, azothioethers and p-nitrobenzenediazonium salts.

The peroxide initiators include almost all compounds so far as they are organic compounds having at least one oxygen-oxygen bond in their molecules. Examples thereof include methyl ethyl-ketone peroxide, cyclohexanone peroxide, 3,3,5-trimethylcyclohexanone peroxide, methylcyclohexanone peroxide, acetylacetone peroxide, 1,1'-bis(tert-butyl-peroxy)-3,3,5-trimethylcyclohexane, 1,1'-bis(tert-butyl-peroxy)cyclohexane, n-butyl-4,4-bis(tert-butylperoxy)valerate, 2,2'-bis(tert-butylperoxy)butane, tert-butyl hydroperoxide, cumene hydroperoxide, 2,5-dimethylhexane-2-dihydroperoxide, 1,1,3,3-tetramethylbutyl hydroperoxide, di-tert-butyl peroxide, tert-butylcumyl peroxide, dicumyl peroxide, α,α'-bis(tert-butylperoxyisopropyl)benzene, 2,5-dimethyl-2,5-di(tert-butylperoxy)hexane, 2,5-dimethyl-2,5-di(tertbutyl-peroxy)hexyne-3, acetyl peroxide, isobutyryl peroxide, octanoyl peroxide, decanoyl peroxide, lauroyl peroxide, 3,5,5-trimethylhexanoyl peroxide, succinic acid peroxide, benzoyl peroxide, 2,4-dichlorobenzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxydicarbonate, dimethoxyisopropyl peroxydicarbonate, di(3-methyl-3-methoxybutyl) peroxydicarbonate, tert-butyl peroxyacetate, tert-butyl peroxyisobutyrate, tert-butyl peroxypivalate, tert-butyl peroxyneodecanoate, tert-butyl peroxyoctanoate, tert-butyl peroxy-3,5,5-trimethylhexanoate, tert-butyl peroxylaurate, tert-butyl peroxybenzoate, di-tert-butyl diperoxyisophthalate, 2,5-dimethyl-2,5-di(benzoylperoxy)hexane, tert-butylmaleic acid peroxide and tertbutyl peroxyisopropylcarbonate. However, the heat-induced polymerization initiators used in the present invention are not limited to these compounds, and other known heat-induced polymerization initiators may also be used.

Examples of the photo-induced polymerization initiators include carbonyl compounds, sulfur compounds, halogen compounds and redox photo-induced polymerization initiators.

Specific examples of the carbonyl compounds include diketones such as benzil, 4,4-dimethoxybenzil, diacetyl and camphorquinone; benzophenones such as 4,4'-diethylaminobenzophenone and 4,4'-dimethoxybenzophenone; acetophenones such as acetophenone and 4-methoxyacetophenone; benzoin alkyl ethers; thioxanthones such as 2-chlorothioxanthone, 2,5-diethylthioxanthone and thioxanthone-3-carboxylic acid β-methoxyethyl ester; chalconic acids group and styryl ketones having a dialkylamino group; and coumarins such as 3,3'-carbonylbis(7-methoxy-coumarin) and 3,3'-carbonylbis (7-diethylaminocoumarin).

Examples of the sulfur compounds include disulfides such as dibenzothiazolyl disulfide and decylphenyl disulfide.

Examples of the halogen compounds include carbon tetrabromide, quinolinesulfonyl chloride and S-triazines having a trihalomethyl group.

Examples of the redox photo-induced polymerization initiators include combinations of trivalent iron ion compound (for example, ammonium ferric citrate) and a peroxide, and combinations of a photo-reducing substance such as riboflavin or methylene blue and a reducing agent such as triethanolamine or ascorbic acid.

It is also possible to use two or more of the above-mentioned photo-induced polymerization initiators in combination to more efficiently achieve a photopolymerization reaction.

Examples of such a combination include combinations of a chalcon or styrylstyryl ketone having a dialkylamino group, or a coumarin and an S-triazine having a trihalomethyl group, or camphorquinone.

It is also possible to use the heat-induced polymerization initiator and the photo-induced polymerization initiator in combination.

As a component for forming the ink-receiving layer, there may be contained a binder having no polymerizability as needed. Specific examples of such a binder include cellulose esters such as nitrocellulose, cellulose phosphate, cellulose sulfate, cellulose acetate, cellulose propionate, cellulose butyrate, cellulose myristate, cellulose palmitate, cellulose acetate propionate and cellulose acetate butyrate; cellulose ethers such as methylcellulose, ethylcellulose, propylcellulose and butylcellulose; vinyl polymers such as polystyrene, polyvinyl chloride, polyvinyl acetate, polyvinyl butyral, polyvinyl formal, polyvinyl acetal, polyvinyl alcohol and polyvinyl pyrrolidone; copolymers such as styrene-butadiene copolymers, styrene-acrylonitrile copolymers, styrene-butadiene-acrylonitrile copolymers and vinyl chloride-vinyl acetate copolymers; acrylic polymers such as polymethyl methacrylate, polymethyl acrylate, polybutyl acrylate, polyacrylic acid, polymethacrylic acid, polyacrylamide and polyacrylonitrile; polyesters such as polyethylene terephthalate; polycarbonate polymers such as poly(4,4-isopropylidenediphenylene-co-1,4-cyclohexylenedimethylenecarbonate), poly(ethylenedioxy-3,3'-phenylenethiocarbonate), poly(4,4'-isopropylidenediphenylenecarbonate-co-terephthalate), poly(4,4'-isopropylidenediphenylenecarbonate), poly(4,4'-sec-butylidenediphenylenecarbonate) and poly(4,4'-isopropylidenediphenylenecarbonate-block-oxyethylene); polyamides and polyimides; epoxy polymers; phenolic polymers; polyolefins such as polyethylene, polypropylene and chlorinated polyethylene; and other natural or synthetic resins such as gelatin. Of these, vinyl polymers such as polyvinyl butyral, polyvinyl formal and polyvinyl acetal, and vinyl copolymers such as vinyl chloride-vinyl acetate copolymers are particularly preferred.

Upon the preparation of the dispersion comprising the alumina hydrate and the polymerizable compound, organic solvents are used as a dispersion medium, solvent, diluent and the like as needed. Specific examples of the organic solvents include alcohols such as methanol, ethanol and isopropanol; ketones such as acetone, methyl ethyl ketone, cyclohexanone and diacetone alcohol; amides such as N,N-dimethylformamide and N,N-dimethylacetamide; sulfoxides such as dimethyl sulfoxide; ethers such as tetrahydrofuran, dioxane and ethylene glycol monomethyl ether: esters such as methyl acetate, ethyl acetate and butyl acetate; aliphatic halogenated hydrocarbons such as chloroform, methylene chloride, dichloroethylene, carbon tetrachloride and trichloroethylene; aromatics such as benzene, toluene, xylene, monochlorobenzene and dichlorobenzene; aliphatic or alicyclic hydrocarbons such as n-hexane, cyclohexane and ligroin; and fluorine-containing solvents such as tetrafluoropropanol and pentafluoropropanol. These solvents may be used either singly or in any combination thereof.

Since the alumina hydrate is surface-treated with the coupling agent such as silane in advance, which is a feature of the present invention, water-dispersible pigments can be used even in an organic system (a system containing a polymerizable compound and an organic solvent), and there are thus brought about such effects that the defoaming ability and stability of the dispersion are improved compared with an aqueous system, and high-speed coating becomes feasible.

When an aqueous system is used from the viewpoint of ecology, those having hydrophilicity among the above-mentioned polymerizable compounds are used. As the binder (having no polymerizability) optionally used, a water-soluble polymeric substance, the specific examples of which are mentioned below, is preferably used. Namely, preferable examples thereof include polyvinyl alcohol or modified products thereof (cationically modified, anionically modified, silanol modified), starch or modified products thereof (oxidized, etherified), gelatin or modified products thereof, casein or modified products thereof, gum arabic, cellulose derivatives such as carboxymethylcellulose, hydroxyethylcellulose and hydroxypropylmethylcellulose, conjugated diene copolymer latexes such as SBR latexes, NBR latexes and methyl methacrylate-butadiene copolymers, functional group-modified polymer latexes, vinyl copolymer latexes such as ethylene-vinyl acetate copolymers, polyvinyl pyrrolidone, maleic anhydride polymer or copolymers thereof, acrylic ester copolymers, acrylamide resins and the like. These binders may be used either singly or in any combination thereof.

The mixing ratio of the total amount of the polymerizable compound and the binder to the alumina hydrate may be optionally selected from a range of from 1:1 to 1:30, preferably from 1:5 to 1:20 so far as the BET specific surface area and pore volume of the resulting ink-receiving layer satisfy the above ranges, respectively. If the total amount of the polymerizable compound and the binder is less than the lower limit of the above range, the mechanical strength of the resulting ink-receiving layer becomes insufficient, which tends to form the cause of cracking and dusting. If the total amount is greater than the upper limit of the above range, the pore volume of the resulting ink-receiving layer is reduced, resulting in a recording medium liable to lower ink absorbency.

Means for polymerizing the polymerizable compound include electron beam irradiation, ultraviolet light irradiation, heating and the like.

In the electron beam (EB) irradiation, an electron beam irradiator of the scanning or curtain type is used. There is no particular need to use a polymerization initiator.

In the ultraviolet light irradiation, for example, sunlight, a tungsten lamp, a mercury lamp, a halogen lamp, a xenon lamp or a fluorescent lamp may be used. In this case, there is need to use a photo-induced polymerization initiator as a polymerization initiator. Rays having a wavelength at which the rays are absorbed in the photo-induced polymerization initiator are irradiated.

In the heating, any of the above-mentioned dryers, a hot plate, a heated roll, a thermal head or the like may be used. Besides, there may also be used a heating method in which a heating element is provided in the substrate to energize it, or a heating method by infrared ray irradiation or laser beam irradiation. In this case, there is need to use a heat-induced polymerization initiator as a polymerization initiator. The heating temperature varies according to various conditions. However, it is desirably within a range of from 70 to 250° C., more preferably from 80 to 160° C. In the step of drying after the coating, it may be permissible to conduct both removal of the organic solvent and heat polymerization at the same time.

It is also possible to conduct the heating by the above heating means at the same time as the polymerization by the electron beam irradiation or ultraviolet light irradiation so as to accelerate the polymerization rate.

The above-described means for polymerization may be used in various combinations.

The ink-receiving layer in the present invention may be either a single-layer structure or a multi-layer structure. As examples of the multi-layer structure, may be mentioned the structures described in Japanese Patent Application Laid-Open Nos. 57-89954, 60-224578 and 61-12388. For example, the ink-penetrating layer described in Japanese Patent Application Laid-Open No. 61-12388 may be further provided on the ink-receiving layer according to the present invention. Besides, the ink-receiving layer is provided on at least one side of the substrate, but it may be provided on both sides of the substrate for the purpose of preventing curling of the resulting printing medium and permitting printing on both sides of the printing medium.

Inks used in the image-forming process according to the present invention comprise principally a coloring material (dye or pigment), a water-soluble organic solvent and water. Preferable examples of the dye include water-soluble dyes represented by direct dyes, acid dyes, basic dyes, reactive dyes and food colors. However, any dyes may be used so far as they provide images satisfying required performance such as fixing ability, coloring ability, brightness, stability, light fastness and the like in combination with the printing media.

The water-soluble dyes are generally used by dissolving them in water or a solvent composed of water and at least one organic solvent. As a preferable solvent component for these dyes, there may be used a mixed solvent composed of water and at least one of various water-soluble organic solvents. It is, however, preferable to control the content of water in an ink within a range of from 20 to 90% by weight, more preferably from 60 to 90% by weight.

A solubilizer may also be added to the inks with a view toward enhancing the solubility of the water-soluble dye in the solvent by leaps and bounds. In order to further improve the properties of inks, additives such as viscosity modifiers, surfactants, surface tension modifiers, pH adjustors, resistivity regulative agents and storage stabilizers may be added to the inks.

A process for forming an image by applying the above-described inks to the printing medium, thereby conducting printing is preferably according to an ink-jet printing method. As such a method, any system may be used so far as it can effectively eject an ink out of a nozzle to apply it to the printing medium.

In particular, an ink-jet system described in Japanese Patent Application Laid-Open No. 54-59936, in which an ink undergoes a rapid volumetric change by an action of thermal energy applied to the ink, so that the ink is ejected out of a nozzle by the working force generated by this change of state, may be used effectively.

The present invention will hereinafter be described more specifically by the following Examples. However, the present invention is not limited to these examples. Incidentally, all designations of "part" or "parts" as will be used in the following examples mean part or parts by weight unless expressly noted.

Preparation of Alumina Hydrate

Aluminum dodeoxide was prepared in accordance with the process described in U.S. Pat. No. 4,242,271. The aluminum dodeoxide was then hydrolyzed in accordance with the process described in U.S. Pat. No. 4,202,870 to prepare an alumina slurry. Water was added to the alumina slurry until the solids content of alumina hydrate was 7.9%. The pH of the alumina slurry added with water was 9.5. A 3.9% nitric acid solution was added to this slurry to adjust the pH of the slurry, thereby obtaining colloidal sol. This colloidal sol was spray-dried at 75° C. to obtain alumina hydrate (A or B) shown in Table 1. The BET specific surface area and pore volume of these alumina hydrates were determined in accordance with the following respective methods.

1) Pore Volume (PV):

After an alumina hydrate sample was subjected to a dearation treatment at 120° C. for 24 hours, measurement was conducted using the nitrogen adsorption and desorption method by means of an "Autosorb I" (trade name, manufactured by Quanthachrome Co.).

2) BET Specific Surface Area (SA):

The BET specific surface area of the alumina hydrate sample was calculated in accordance with the method of Brunauer, et al.

The results of the measurement are shown in Table 1.

TABLE 1

| Alumina hydrate | SA ($m^2/g$) | PV (ml/g) |
|---|---|---|
| A | 105.4 | 0.54 |
| B | 235.6 | 0.59 |

EXAMPLE 1

Wet Process

Preparation of Alumina Hydrate Treated with a Coupling Agent

One hundred parts of the alumina hydrate B were gradually added to a mixed solvent of methanol/water (weight ratio: 8/2) and stirred for 15 minutes at 8,000 rpm by means of a disperser (T.K. Homomixer M type, trade name, manufactured by Tokushu Kika Kogyo Co., Ltd.). While stirring the resultant dispersion, 22.4 parts of a 5% methanol solution containing 1.12 parts of γ-methacryloxypropyltrimethoxysilane (A-174, trade name, minimum area coverage: 316 $m^2/g$, product of Nippon Unicar Co., Ltd.) were then gradually added dropwise over 20 minutes, followed by further stirring for 10 minutes at 8,000 rpm by means of the disperser. The resultant mixture was charged into a rotary evaporator to remove the solvent while heating at 75° C. The residual slurry was spread over a shallow tray and dried at 110° C. for 3 hours to conduct a treatment with the coupling agent. The mixture was then ground to obtain an alumina hydrate treated with the silane coupling agent (a proportion of an area covered with the coupling agent by the surface treatment of the surface area: 1.5%).

Production Example 1 of Printing Medium

Organic solvent dispersion system

A dispersion (solids concentration: 18%) obtained by dispersing the alumina hydrate B treated with the coupling agent in methyl cellosolve and a methyl cellosolve solution (solids concentration: 10%) of polyvinyl butyral ("S-lec BX-1", trade name, product of Sekisui Chemical Co., Ltd.) were weighed out so as to give a weight ratio in terms of solids (P/B ratio=weight of solid alumina hydrate treated with the coupling agent/weight of solid polyvinyl butyral) of 10:1, and the resultant mixture was subjected to ball milling for 24 hours, thereby obtaining a mixed dispersion (the total solids concentration of the alumina hydrate treated with the coupling agent and polyvinyl butyral: 15% by weight).

The mixed dispersion was applied at a coating rate of 200 m/min by gravure coating onto a white polyester film ("Lumirror X-21", trade name, product of Toray Industries, Inc., thickness: 100 μm; hereinafter abbreviated as "WP") as a substrate while subjecting the film to a corona discharge treatment, and then dried at 120° C. to form an ink-receiving layer having a dry coating thickness of 35 μm, thereby obtaining a printing medium according to the present invention.

The various physical properties of the resultant printing medium were determined and evaluated in accordance with the respective methods described below. The results are shown in Table 4.

EXAMPLES 2 TO 5 AND REFERENTIAL EXAMPLES 1 AND 2

The alumina hydrate was treated in the same manner as in Example 1 except that the amount of γ-methacryloxypropyltrimethoxysilane added upon the preparation of the alumina hydrate treated with the coupling agent in Example 1 was changed as shown in Table 2, thereby obtaining respective alumina hydrates treated with the silane coupling agent.

Dispersion and coating were performed in the same manner as in Example 1 to obtain printing media. The physical properties of the resultant printing media were determined and evaluated in the same manner as in Example 1. The results are shown in Table 4.

TABLE 2

| | Amount added (parts) | Proportion of an area covered*) with the coupling agent (%) |
|---|---|---|
| Ex. 1 | 1.12 | 1.5 |
| Ex. 2 | 0.37 | 0.5 |

TABLE 2-continued

| | Amount added (parts) | Proportion of an area covered*) with the coupling agent (%) |
|---|---|---|
| Ex. 3 | 3.7 | 5.0 |
| Ex. 4 | 11.2 | 15.0 |
| Ex. 5 | 22.4 | 30.0 |
| Ref. Ex. 1 | 33.6 | 45.0 |
| Ref. Ex. 2 | 0 | 0 (Untreated) |

*)Determined by calculation from the amount of γ-methacryloxypropyltrimethoxysilane to be added for covering 100 parts of the alumina hydrate B by 100%:100 × 235.6 ($m^2/g$)/316 ($m^2/g$) = 74.56 parts.

EXAMPLE 6

The surface treatment with the silane coupling agent, dispersion and coating-were performed in the same manner as in Example 1 except that the alumina hydrate B was changed to the alumina hydrate A, thereby obtaining a printing medium. The physical properties of the resultant printing medium were determined and evaluated in the same manner as in Example 1. The results are shown in Table 4.

EXAMPLE 7

Dry Process

One hundred parts of the alumina hydrate B were charged into a Henschel mixer. While mixing and stirring the alumina hydrate, a solution obtained by mixing 1.12 parts of γ-methacryloxypropyltrimethoxysilane and 100 parts of xylene was gradually added by spraying in such a manner that a proportion of an area covered with the coupling agent by the surface treatment amounted to 1.5%. After completion of the addition, the thus-treated alumina hydrate was heated to 75° C., thereby volatilizing xylene alone to recover it. The alumina hydrate was further heated at 120° C. for 3 hours to dry it, thereby obtaining an alumina hydrate treated with the silane coupling agent.

Dispersion and coating were then performed in the same manner as in Example 1 to obtain a printing medium. The physical properties of the resultant printing medium were determined and evaluated in the same manner as in Example 1. The results are shown in Table 4.

EXAMPLE 8

Integral Blending

A methyl cellosolve solution containing 1.12 parts of γ-methacryloxypropyltrimethoxysilane was added to the untreated alumina hydrate B to prepare a dispersion and perform the coating of the dispersion in the same manner as in Example 1, thereby obtaining a printing medium. The physical properties of the resultant printing medium were determined and evaluated in the same manner as in Example 1. The results are shown in Table 4.

EXAMPLES 9 TO 17

In a similar manner to Example 1, the alumina hydrates A and B were treated with coupling agents shown in Table 3 in their corresponding combinations and amounts to be added shown in Table 4, thereby obtaining alumina hydrates treated with the respective coupling agents. Dispersion and coating were then performed in the same manner as in Example 1 to obtain printing media. The physical properties of the resultant printing media were determined and evaluated in the same manner as in Example 1. The results are shown in Table 4.

TABLE 3

| Sample No. | Coupling agent |
|---|---|
| 1 | γ-Methacryloxypropyltrimethoxysilane (A-174, trade name, product of Nippon Unicar Co., Ltd.) |
| 2 | γ-Glycidoxypropyltrimethoxysilane (A-187, trade name, product of Nippon Unicar Co., Ltd.) |
| 3 | γ-Aminopropyltrimethoxysilane (A-1100, trade name, product of Nippon Unicar Co., Ltd.) |
| 4 | γ-Mercaptopropyltrimethoxysilane (A-189, trade name, product of Nippon Unicar Co., Ltd.) |
| 5 | Methyltrimethoxysilane (TSL8113, trade name, product of Toshiba Silicone Co., Ltd.) |
| 6 | Octadecyltrimethoxysilane (TSL8185, trade name, product of Toshiba Silicone Co., Ltd.) |
| 7 | Isopropyltri(N-aminoethyl-aminoethyl) titanate (Preneact KR-44, product of Ajinomoto Co., Inc.) |
| 8 | Isopropyltrimethylstearoyl titanate (product of Ajinomoto Co., Inc.) |
| 9 | Acetoalkoxyaluminum diisopropionate (product of Ajinomoto Co., Inc.) |
| 10 | Acetylacetone zirconium butyrate (product of Matsumoto Seiyaku K.K) |

Besides the white polyester film (WP), resin-coated paper (product of Shin-Oji Paper Co., Ltd., thickness: 180 μm; abbreviated as "RC") and a transparent polyester film (Lumirror T, product of Toray Industries, Inc., thickness: 100 μm; abbreviated as "TP") were also used as substrates.

EXAMPLE 18

The alumina-hydrate B treated with the silane coupling agent in Example 1 and the untreated alumina hydrate A were dispersed in a 6:4 mixed solvent of isopropyl alcohol (IPA)/water so as to give a weight ratio of 8:2, thereby obtaining a dispersion (solids concentration: 18%). This dispersion and a solution (solids concentration: 8%) of polyvinyl acetal ("S-lec KX-1", trade name, product of Sekisui Chemical Co., Ltd.) in a 6:4 mixed solvent of PAP/water were weighed out so as to give a weight ratio in terms of solids (P/B ratio) of 10:1, and the resultant mixture was subjected to ball milling for 24 hours, thereby obtaining a mixed dispersion.

The mixed dispersion was applied at a coating rate of 50 m/min by kiss coating onto WP as a substrate while subjecting the substrate to a corona discharge treatment, and then dried at 120° C., thereby obtaining a printing medium provided with an ink-receiving layer having a dry coating thickness of 35 μm.

The physical properties of the resultant printing medium were determined and evaluated in the same manner as in Example 1. The results are shown in Table 4.

EXAMPLE 19

Dispersion and coating were performed in the same manner as in Example 18 except that untreated silica [colloidal silica, Snowtex IPA-ST (trade name, a 30% by weight dispersion in isopropanol), product of Nissan Chemical Industries, Ltd.] was used in place of the untreated alumina hydrate A in Example 18, thereby obtaining a printing medium. The physical properties of the resultant printing medium were determined and evaluated in the same manner as in Example 1. The results are shown in Table 4.

REFERENTIAL EXAMPLE 3

A dispersion (solids concentration: 18%) obtained by dispersing the alumina hydrate B treated with no coupling agent in deionized water and an aqueous solution (solids concentration 10%) obtained by dissolving polyvinyl alcohol (Gohsenol NH-18, trade name, product of The Nippon Synthetic Chemical Industry Co., Ltd.) in deionized water were weighed out so as to give a weight ratio in terms of solids (P/B ratio) of 10:1, and the resultant mixture was subjected to ball milling for 24 hours, thereby obtaining a mixed dispersion (solids concentration: 15%).

The mixed dispersion was applied at a coating rate of 10 m/min by the same gravure coater as that used in Example 1 onto WP and dried in the same manner as in Example 1, thereby obtaining a printing medium provided with an ink-receiving layer having a dry coating thickness of 35 μm. The physical properties of the resultant printing medium were determined and evaluated in the same manner as in Example 1. The results are shown in Table 4.

The determining and evaluating methods used in the above Examples will hereinafter be described.

Evaluating and Determining Method 1 of Physical Properties of Dispersion

1) Dispersing State:

The dispersing state was visually evaluated. It was ranked as AA where neither gelation nor deposition of insoluble matter occurred, and the dispersing state was hence good, A where the dispersing state was good, but the viscosity was somewhat high, or C where gelation or deposition of insoluble matter occurred, resulting in a failure to disperse.

Evaluating and Determining Method 1 of Physical Properties of Ink-receiving Layer 1) Coating State of Ink-receiving Layer:

The coating state was visually evaluated. It was ranked as A where a smooth surface was formed, and the coating state was hence good, or C where the surface developed defects such as formation of a rough surface or deposition of insoluble matter.

2) Glossiness:

Glossiness was measured on seven non-printed areas of each printing medium sample by means of a glossmeter (Glosschecker IG-320, trade name, manufactured by Horiba Ltd.) to determine an average value thereof.

3) Printability:

Using an ink-jet printer equipped with four drop-on-demand type ink-jet heads for yellow (Y), magenta (M), cyan (C) and black (Bk) inks, each of which has 128 nozzles at intervals of 16 nozzles per mm, ink-jet printing was performed on each printing medium sample with inks of the following composition, thereby evaluating the printing medium sample as to ink absorbency, optical density of an image formed, bleeding and beading. The evaluation was conducted under normal conditions (23° C. and 60% RH).

a) Ink Absorbency:

Right after single-color or multi-color solid printing was conducted on each printing medium sample with the Y, M, C and Bk inks of the following composition, the printed area of the printing medium sample was touched with a finger to determine the drying condition of the inks on the surface of the printing medium. The quantity of ink of 32×32 dots per $mm^2$ with the ink ejected in a proportion of 30 ng per dot on the ink-receiving layer was determined as 400%. Besides, the quantity of ink in the single-color printing was determined as 100%. The ink absorbency was ranked as AA where none of the inks adhered to the finger in an ink quantity of 300%, A where none of the inks adhered to the finger in an ink quantity of 200%, or B where none of the inks adhered to the finger in an ink quantity of 100%.

b) Optical Density:

Solid printing was conducted on each printing medium sample with the M ink of the following composition. The optical density of the image formed was measured by means of a Macbeth reflection densitometer RD1255 (In each of the examples, the optical density of the image formed with the M ink of the four inks was the lowest. Therefore, the optical density was expressed by this value).

c) Bleeding and Beading:

After single-color or multi-color solid printing was conducted on each printing medium sample with the Y, M, C and Bk inks of the following composition, the printing medium thus printed was visually observed as to whether bleeding on its surfaces or beading both on the surface and in the interior thereof occurred. The quantity of ink in the single-color printing was determined as 100%. The resistance to bleeding or the resistance to beading of the printing medium sample was ranked as AA where bleeding or beading did not occur in an ink quantity of 300%, A where bleeding or beading did not occur in an ink quantity of 200%, or B where bleeding or beading did not occur in an ink quantity of 100%.

Ink Composition

| | |
|---|---|
| Dye (Y, M, C or Bk) | 5 parts |
| Ethylene glycol | 10 parts |
| Polyethylene glycol | 10 parts |
| Water | 75 parts. |

Dye in Ink

Yellow (Y): C.I. Direct Yellow 86
Magenta (M): C.I. Acid Red 35
Cyan (C): C.I. Direct Blue 199
Black (Bk): C.I. Food Black 2.

d) Water Fastness:

After solid printing was conducted on each printing medium sample with the M ink of the above-described composition, the printing medium sample thus printed was immersed for 3 minutes in running water and then air-dried to determine the fastness to water of the image formed on the printing medium in accordance with the following equation:

$$\text{Fastness to water (\%)} = \frac{\text{(Optical density of the image before the immersion)}}{\text{(Optical density of the image after the immersion)}} \times 100$$

The water fastness was ranked as AA where a value of the fastness to water was not lower than 95%, A where the value was not lower than 88% but lower than 95%, or B where the value was lower than 88% (In each of the examples, the water fastness of the image formed with the M ink of the four inks was the lowest. Therefore, the water fastness was expressed by this value).

e) Analysis of Quantitative Ratio of the Coupling Agent to the Alumina Hydrate (Ratio Between the Numbers of Atoms):

The surface of the ink-receiving layer of each printing medium sample was analyzed by means of ESCA (ESCALAB 220i-XL, manufactured by FISONS) under the following conditions:

Excitation source: Monochromatic Al Kα (1486.6 eV) 10 kV-18 mA

Analyzing region: About 1 mm in diameter

Positive charge neutralizing electron gun: 4 eV-0.1 mA

Pressure within the apparatus during measurement: $5\times10^{-9}$ Torr or lower High-pass spectrum measurement: Pass energy=50 eV, 0–1,400 eV Low-pass spectrum measurement: Pass energy=20 eV.

TABLE 4

| Example | 1 | 2 | 3 | 4 | 5 | Ref. 1 | Ref. 2 | 6 | 7 | 8 | 9 |
|---|---|---|---|---|---|---|---|---|---|---|---|
| Alumina hydrate | B | B | B | B | B | B | B | A | B | B | A |
| Coupling agent | 1 | 1 | 1 | 1 | 1 | 1 | None | 1 | 1[1)] | 1[2)] | 2 |
| Proportion of covered area (%) | 1.5 | 0.5 | 5.0 | 15.0 | 30.0 | 45.0 | 0 | 1.5 | 1.5 | 1.5 | 3.0 |
| Dispersing state | AA | A | AA | AA | AA | AA | Untreated C (gelled) | AA | AA | A | AA |
| Substrate | WP | WP | WP | WP | WP | WP | WP | WP | WP | WP | RC |
| Coating rate (m/min) | 200 | 200 | 200 | 200 | 200 | 200 | Uncoated | 200 | 200 | 200 | 150 |
| Coating of ink-receiving layer | A | A | A | A | A | A | — | A | A | A | A |
| Glossiness | 63.0 | 62.7 | 63.4 | 63.9 | 64.3 | 64.5 | — | 61.5 | 62.9 | 62.7 | 62.0 |
| Ink absorbency | AA | AA | AA | AA | A | B | — | AA | AA | AA | AA |
| Optical density | 1.85 | 1.84 | 1.88 | 1.86 | 1.82 | 1.78 | — | 1.89 | 1.84 | 1.82 | 1.87 |
| Bleeding | AA | AA | AA | AA | AA | B | — | AA | AA | AA | AA |
| Beading | AA | AA | AA | AA | AA | A | — | AA | AA | AA | AA |
| Water fastness | AA | AA | AA | AA | AA | AA | — | AA | AA | AA | AA |
| Peak ratio in ESCA | 0.0137 | 0.0045 | 0.0452 | 0.1367 | 0.2733 | 0.4102 | — | 0.0139 | 0.0136 | 0.0138 | 0.0278 |

TABLE 4-continued

[1]: Dry treatment;
[2]: Integral blending.

| Example | 10 | 11 | 12 | 13 | 14 | 15 | 16 | 17 | 18 | 19 | Ref. 3 |
|---|---|---|---|---|---|---|---|---|---|---|---|
| Alumina hydrate | B | A | B | A | B | A | B | A | B | B | B |
| Coupling agent | 3 | 4 | 5 | 6 | 7 | 8 | 9 | 10 | 1 | 1 | — |
| Proportion of covered area (%) | 5.0 | 2.0 | 2.0 | 2.0 | 1.0 | 1.0 | 1.5 | 1.5 | 1.5 | 1.5 | 0 |
| Dispersing state | AA | AA | AA | AA | AA | AA | AA | AA | A | A | AA |
| Substrate | RC | RC | TP | TP | WP | RC | WP | WP | WP | TP | WP |
| Coating rate (m/min) | 150 | 150 | 150 | 150 | 200 | 200 | 200 | 200 | 50 | 50 | 10 |
| Coating of ink-receiving layer | A | A | A | A | A | A | A | A | A | C[3] | A |
| Glossiness | 63.5 | 61.9 | 63.3 | 61.7 | 62.9 | 61.6 | 63.0 | 61.8 | 61.0 | 5.3 | 60.3 |
| Ink absorbency | AA | AA | AA | AA | AA | AA | AA | AA | AA | AA | AA |
| Optical density | 1.86 | 1.87 | 1.85 | 1.87 | 1.84 | 1.88 | 1.85 | 1.86 | 1.79 | 1.78 | 1.78 |
| Bleeding | AA | AA | AA | AA | AA | AA | AA | AA | AA | AA | AA |
| Beading | AA | AA | AA | AA | AA | AA | AA | AA | AA | AA | A |
| Water fastness | AA | AA | AA | AA | AA | AA | AA | AA | AA | A | A |
| Peak ratio in ESCA | 0.0456 | 0.1857 | 0.0182 | 0.0185 | 0.0091 | 0.0093 | 0.0138 | 0.0138 | 0.0138 | 0.0139 | 0.0000 |

[3]: Mat.

EXAMPLE 20

Aqueous Integral Blending

Preparation of Alumina Hydrate Treated With a Coupling Agent

One hundred parts of the alumina hydrate B were added to a mixed solvent of deionized water/DMF (weight ratio: 8/2) and stirred for 30 minutes at a rotating speed of 1,450 rpm by means of a disperser (Portable Mixer A510, trade name, using DS impeller blade, manufactured by Satake Chemical Equipment Mfg., Ltd.).

While stirring the resultant dispersion, a 2% aqueous solution (obtained by adjusting pH to 2 with acetic acid to dissolve) containing 2.24 parts of γ-methacryloxypropyltrimethoxysilane (A-174, trade name, minimum area coverage: 316 $m^2/g$, product of Nippon Unicar Co., Ltd.) was then added.

A proportion of an area covered with the coupling agent by the surface treatment of the surface area of the resultant alumina hydrate was 3.0%.

Production Example 2 of Printing Medium

An aqueous solution (solids concentration: 10%) obtained by dissolving polyvinyl alcohol (Gohsenol GH-23, trade name, product of The Nippon Synthetic Chemical Industry Co., Ltd.) in deionized water was weighed out so as to give a weight ratio of the alumina hydrate B to the polyvinyl alcohol in terms of solids (P/B ratio) of 10:1, and added to the above-prepared dispersion. A water-soluble melamine resin (SUMIREZ RESIN 613 Special, trade name, product of Sumitomo Chemical Co., Ltd.) as a hardener was further added to the dispersion so as to give a weight ratio of the polyvinyl alcohol to the hardener in terms of solids-of 10:2.5. The resultant mixture was stirred for 3 hours at a rotating speed of 1,450 rpm, thereby obtaining a mixed dispersion (the total solids concentration of the alumina hydrate, polyvinyl alcohol and water-soluble melamine resin: 18% by weight) finally containing the alumina hydrate and (the polyvinyl alcohol and the water-soluble melamine resin) in a weight ratio of 8:1.

The mixed dispersion was applied at a coating rate of 10 m/min by kiss coating onto a transparent polyester film (TP) while subjecting the film to a corona discharge treatment, and dried at 145° C. to form an ink-receiving layer having a dry coating thickness of 40 μm, thereby obtaining a printing medium according to the present invention.

The physical properties and evaluation results of the printing medium are shown in Table 6.

EXAMPLES 21 TO 25 AND REFERENTIAL EXAMPLES 4 AND 5

Printing media were obtained in the same manner as in Example 20 except that the amount of γ-methacryloxypropyltrimethoxysilane added in Example 20 was changed as shown in Table 5. The physical properties and evaluation results of the printing media are shown in Table 6.

TABLE 5

| | Amount added (parts) | Proportion of an area covered*) with the coupling agent (%) |
|---|---|---|
| Ex. 20 | 2.24 | 3.0 |
| Ex. 21 | 0.37 | 0.5 |
| Ex. 22 | 1.12 | 1.5 |
| Ex. 23 | 3.7 | 5.0 |
| Ex. 24 | 11.2 | 15.0 |
| Ex. 25 | 22.4 | 30.0 |
| Ref. Ex. 4 | 33.6 | 45.0 |
| Ref. Ex. 5 | 0 | 0 (Untreated) |

*)Determined by calculation from the amount of γ-methacryloxypropyltrimethoxysilane to be added for covering 100 parts of the alumina hydrate B by 100%:100 × 235.6 ($m^2/g$)/316 ($m^2/g$) = 74.56 parts.

EXAMPLE 26

The surface treatment with the silane coupling agent and dispersion were performed in the same manner as in Example 20 except that the alumina hydrate B was changed to the alumina hydrate A. The resultant dispersion was applied onto a white polyester film (WP), thereby obtaining a printing medium. The physical properties and evaluation results of the printing medium are shown in Table 6.

EXAMPLE 27

The surface treatment with the silane coupling agent, dispersion and coating were performed in the same manner as in Example 20 except that DMF used in Example 20 was changed to deionized water, thereby obtaining a printing medium. The physical properties and evaluation results of the printing medium are shown in Table 6.

The printing medium exhibited sufficient ink absorbency, but was somewhat lowered in ink-absorbing rate.

EXAMPLES 28 TO 36

In a similar manner to Example 20, the alumina hydrates A and B were treated with coupling agents shown in the above Table 3 in their corresponding combinations and amounts to be added shown in Table 6, thereby obtaining alumina hydrates treated with the respective coupling agents. Dispersion and coating were then performed in the same manner as in Example 20 to obtain printing media. The physical properties and evaluation results of the printing media are shown in Table 6.

COMPARATIVE EXAMPLE 1

The surface treatment with the silane coupling agent, dispersion and coating were performed in the same manner as in Example 20 except that the alumina hydrate B in Example 20 was changed to silica (Mizukasil P-78A, trade name, BET specific surface area: 350 $m^2/g$, BET pore volume: 1.53 ml/g, average particle diameter: 2.0 $\mu$m, product of Mizusawa Industrial Chemicals, Ltd.), thereby obtaining a printing medium. The physical properties and evaluation results of the printing medium are shown in Table 6.

EXAMPLE 37

The organic solvent dispersion obtained in Example 1 was applied onto the ink-receiving layer formed in Example 20 and then dried to form a second ink-receiving layer having a dry coating thickness of 10 $\mu$m, thereby obtaining a printing medium. The physical properties and evaluation results of the printing medium are shown in Table 6.

EXAMPLE 38

The organic solvent dispersion obtained in Example 1 was applied onto the ink-receiving layer formed in Referential Example 5 and then dried to form a second ink-receiving layer having a dry coating thickness of 10 $\mu$m, thereby obtaining a printing medium. The physical properties and evaluation results of the printing medium are shown in Table 6.

EXAMPLE 39

A 5% aqueous solution of an acrylic acid-vinyl alcohol copolymer (SUMIKAGEL L-5H, trade name, product of Sumitomo Chemical Co., Ltd.) was applied at a coating rate of 10 m/min by gravure coating onto a transparent polyester film (TP) and dried at 145° C., thereby forming a first ink-receiving layer having a dry coating thickness of 10 $\mu$m. The organic solvent dispersion obtained in Example 1 was further applied onto the ink-receiving layer thus formed and then dried to form a second ink-receiving layer having a dry coating thickness of 10 $\mu$m, thereby obtaining a printing medium. The physical properties and evaluation results of the printing medium are shown in Table 6.

EXAMPLE 40

A printing medium was obtained in the same manner as in Example 39 except that a 10% aqueous solution obtained by dissolving cationically modified polyvinyl alcohol (Poval CM-318, trade name, product of Kuraray Co., Ltd.) in deionized water was used in place of the 5% aqueous solution of the acrylic acid-vinyl alcohol copolymer in Example 39. The physical properties and evaluation results of the printing medium are shown in Table 6.

EXAMPLE 41

A printing medium was obtained in the same manner as in Example 39 except that an 8% solution of polyvinyl acetal ("S-lec KX-1", trade name, product of Sekisui Chemical Co., Ltd.) in a 4:6 mixed solvent of isopropyl alcohol/deionized water was used in place of the 5% aqueous solution of the acrylic acid-vinyl alcohol copolymer in Example 39. The physical properties and evaluation results of the printing medium are shown in Table 6.

Evaluating and Determining Method 2 of Physical Properties of Dispersion

1) Stability of Dispersion:

The viscosity of each dispersion sample right after completion of its preparation was measured by means of a viscometer (Vismetron No. 2, trade name, rotor: 30 rpm, manufactured by Shibaura System K.K.) to regard it as an initial viscosity.

The viscosity of the dispersion sample was measured upon elapsed time of 24 hours at room temperature after the completion of the preparation to determine the degree of increase in viscosity with time. The dispersion is more stable to long-time coating as the viscosity change of the dispersion is slighter.

Evaluating and Determining Method 2 of Physical Properties of Ink-receiving Layer The same evaluation as in the evaluating and determining method 1 of physical properties of ink-receiving layer was performed.

Further, evaluation was performed as to transparency and environmental test which will be described subsequently.

4) Transparency:

The haze degree of a printing medium sample, in which an alumina hydrate dispersion was applied to a transparent PET film, was measured by means of a hazeometer (NDH-1001DP, trade name, manufactured by Nippon Denshoku K.K.) in accordance with JIS K-7105.

5) Environmental Test (Resistance to Beading):

After leaving each printing medium sample to stand for 10 hours under conditions of (1) normal temperature and low humidity (23° C., 5% RH) and (2) high temperature and high humidity (30° C., 80% RH) in which beading is easy to occur, so as to subject the sample to moisture conditioning, the sample was tested under the same conditions as to the printability in the evaluating and determining method 1 of physical properties of ink-receiving layer, thereby evaluating as to beading.

TABLE 6

| Example | 20 | 21 | 22 | 23 | 24 | 25 | Ref. 4 | Ref. 5 | 26 | 27 | 28 |
|---|---|---|---|---|---|---|---|---|---|---|---|
| Alumina hydrate | B | B | B | B | B | B | B | B | A | B | A |
| Coupling agent | 1 | 1 | 1 | 1 | 1 | 1 | 1 | None | 1 | 1 | 2 |
| Proportion of covered area (%) | 3.0 | 0.5 | 1.5 | 5.0 | 15.0 | 30.0 | 45.0 | 0 Untreated | 3.0 | 3.0 | 5.0 |
| Dispersing state | AA | AA | AA | AA | AA | AA | AA | AA | AA | AA | AA |
| Substrate | TP | TP | TP | TP | TP | TP | TP | TP | WP | TP | WP |
| Coating rate (m/min) | 10 | 10 | 10 | 10 | 10 | 10 | 10 | 10 | 10 | 10 | 10 |
| Coating of ink-receiving layer | A | A | A | A | A | A | A | C[4)] | A | A | A |
| Glossiness | 62.4 | 61.5 | 62.0 | 62.9 | 63.3 | 63.7 | 63.9 | 50.4 | 60.6 | 61.4 | 60.8 |
| Ink absorbency | AA | AA | AA | AA | AA | A | B | AA | AA | AA | AA |
| Optical density | 1.87 | 1.85 | 1.86 | 1.87 | 1.84 | 1.83 | 1.79 | 1.78 | 1.88 | 1.86 | 1.87 |
| Bleeding | AA | AA | AA | AA | AA | AA | B | A | AA | AA | AA |
| Beading | AA | AA | AA | AA | AA | AA | A | A | AA | AA | AA |
| Water fastness | AA | AA | AA | AA | AA | AA | AA | A | AA | AA | AA |
| Peak ratio in ESCA | 0.0273 | 0.0046 | 0.0136 | 0.0454 | 0.1365 | 0.2741 | 0.4101 | 0.0000 | 0.0275 | 0.0274 | 0.0456 |
| Viscosity of dispersion: | | | | | | | | | | | |
| Initial viscosity (cP) | 153 | 165 | 156 | 148 | 146 | 142 | 141 | 185 | 135 | 225 | 128 |
| Viscosity after 24 hr (cP) | 272 | 298 | 277 | 261 | 257 | 250 | 251 | 655 | 240 | 395 | 232 |
| Haze degree (%) | 1.5 | 2.0 | 1.7 | 1.4 | 1.3 | 1.3 | 1.2 | 3.9 | — | 1.8 | — |
| Beading at 23° C., 5% RH | AA | AA | AA | AA | AA | AA | A | B | AA | AA | AA |
| Beading at 30° C., 80% RH | AA | AA | AA | AA | AA | AA | A | B | AA | AA | AA |

[4)]: Crack occurred.

| Example | 29 | 30 | 31 | 32 | 33 | 34 | 35 | 36 | Comp. 1 | 37 |
|---|---|---|---|---|---|---|---|---|---|---|
| Alumina hydrate | B | A | B | A | B | A | B | A | Silica | B/B[5)] |
| Coupling agent | 3 | 4 | 5 | 6 | 7 | 8 | 9 | 10 | 1 | 1/1 |
| Proportion of covered area (%) | 3.0 | 2.0 | 2.0 | 2.0 | 1.0 | 1.0 | 1.5 | 1.5 | 3.0 | 3.0/1.5 |
| Dispersing state | AA | AA | AA | AA | AA | AA | AA | AA | A | AA |
| Substrate | RC | RC | WP | WP | TP | WP | RC | RC | TP | WP |
| Coating rate (m/min) | 10 | 10 | 10 | 10 | 10 | 10 | 10 | 10 | 10 | 10 |
| Coating of ink-receiving layer | A | A | A | A | A | A | A | A | C | A |
| Glossiness | 63.0 | 60.7 | 62.9 | 61.0 | 62.3 | 60.1 | 62.5 | 60.4 | 5.1 | 63.0 |
| Ink absorbency | AA | AA | AA | AA | AA | AA | AA | AA | AA | AA |
| Optical density | 1.87 | 1.86 | 1.85 | 1.88 | 1.84 | 1.86 | 1.87 | 1.86 | 1.75 | 1.85 |
| Bleeding | AA | AA | AA | AA | AA | AA | AA | AA | AA | AA |
| Beading | AA | AA | AA | AA | AA | AA | AA | AA | AA | AA |
| Water fastness | AA | AA | AA | AA | AA | AA | AA | AA | A | AA |
| Peak ratio in ESCA | 0.0272 | 0.0181 | 0.0180 | 0.0179 | 0.0091 | 0.0093 | 0.0138 | 0.0136 | 0.0274 | 0.0137 |
| Viscosity of dispersion: | | | | | | | | | | |
| Initial viscosity (cP) | 148 | 139 | 155 | 140 | 160 | 142 | 154 | 137 | 176 | — |
| Viscosity after 24 hr (cP) | 265 | 246 | 274 | 244 | 286 | 251 | 270 | 244 | 324 | — |
| Haze degree (%) | — | — | — | — | 1.7 | — | — | — | 95.4 | — |
| Beading at 23° C., 5% RH | AA | AA | AA | AA | AA | AA | AA | AA | A | AA |
| Beading at 30° C., 80% RH | AA | AA | AA | AA | AA | AA | AA | AA | A | AA |

[5)]: The former is the alumina hydrate in the first layer, and the latter is that in the second layer.

| Example | 38 | 39 | 40 | 41 |
|---|---|---|---|---|
| Alumina hydrate | B/B[5)] | —/B[5)] | —/B[5)] | —/B[5)] |
| Coupling agent | None/1 | —/1 | —/1 | —/1 |
| Proportion of covered area (%) | 0/1.5 | —/1.5 | —/1.5 | —/1.5 |
| Dispersing state | AA | AA | AA | AA |
| Substrate | RC | WP | WP | WP |
| Coating rate (m/min) | 10 | 10 | 10 | 10 |
| Coating of ink-receiving layer | A | A | A | A |
| Glossiness | 62.8 | 62.4 | 62.2 | 61.3 |
| Ink absorbency | AA | AA | A | A |
| Optical density | 1.83 | 1.84 | 1.83 | 1.84 |
| Bleeding | AA | AA | AA | AA |
| Beading | AA | AA | AA | AA |
| Water fastness | AA | B | B | B |
| Peak ratio in ESCA | 0.0137 | 0.0136 | 0.0136 | 0.0137 |
| Viscosity of dispersion: | | | | |
| Initial viscosity (cP) | — | — | — | — |

TABLE 6-continued

| | | | | |
|---|---|---|---|---|
| Viscosity after 24 hr (cP) | — | — | — | — |
| Haze degree (%) | — | — | — | — |
| Beading at 23° C., 5% RH | AA | A | A | A |
| Beading at 30° C., 80% RH | AA | A | A | A |

5): The former is the alumina hydrate in the first layer, and the latter is that in the second layer.

EXAMPLE 42

After 100 parts of the alumina hydrate B treated with the silane coupling agent in Example 1 were gradually added to 10 parts of a liquid mixture composed of polymerizable compounds (which were all liquid and had no film-forming properties), i.e., 3 parts of urethane acrylate (Aronix M1210, trade name, product of Toagosei Chemical Industry Co., Ltd.), 3 parts of dipentaerythritol hexaacrylate (Kayalad DPHA, trade name, product of Nippon Kayaku Co., Ltd.) and 4 parts of 2-hydroxyethyl acrylate (HEA, trade name, product of Osaka Organic Chemical Ind. Co., Ltd.) with stirring, the mixture was dispersed for 30 minutes at 5,000 rpm by a disperser and further subjected to ball milling for 24 hours, thereby obtaining a dispersion.

The thus-obtained dispersion was applied at a coating rate of 300 m/min by means of an EB coater (Electrocuratin, manufactured by Energy Science, Inc.; accelerating voltage: 160 kV) onto a transparent polyester film (Lumirror T60, trade name, product of Toray Industries, Inc., thickness: 100 μm; "TP") as a substrate while subjecting the film to a corona discharge treatment to form an ink-receiving layer having a dry coating thickness of 30 μm, thereby obtaining a printing medium according to the present invention.

The various physical properties of the resultant printing medium were determined and evaluated in accordance with the respective methods described below. The results are shown in Table 8.

EXAMPLE 43

A dispersion (solids concentration: 18%) obtained by dispersing the alumina hydrate treated with the silane coupling agent in Example 42 in ethyl cellosolve and a liquid having the following composition were weighed out so as to give a weight ratio of the alumina hydrate to polyvinyl butyral-acrylic acid adduct in terms of solids (P/B ratio) of 10:1, and mixed with stirring.

| | |
|---|---|
| Polyvinyl butyral-acrylic acid adduct (a) (number average molecular weight: 32,500, number of acryloyl groups: 70 per molecule) | 1 part |
| Dipentaerythritol hexaacrylate (Kayalad DPHA, trade name, product of Nippon Kayaku Co., Ltd.) | 1 part |
| 2,4-Diethylthioxanthone (Kayacure DETX, trade name, product of Nippon Kayaku Co., Ltd.) | 0.1 part |
| Ethyl 4-dimethylaminobenzoate (Kayacure EPA, trade name, product of Nippon Kayaku Co., Ltd.) | 0.1 part |
| n-Butanol/ethyl cellosolve (weight ratio = 1:1) | 9 parts. |

Thereafter, the mixture was subjected to ball milling for 24 hours to obtain a mixed dispersion.

Using the same transparent polyester film as that used in Example 42 as a substrate, the mixed dispersion was applied at a coating rate of 150 m/min onto the substrate while subjecting the substrate to a corona discharge treatment, and the thus-coated film was then passed through a drying oven of 120° C. and then exposed to ultraviolet rays (using an ultraviolet light source manufactured by Japan Storage Battery Co., Ltd.) while passing the film through a drying oven of 80° C., thereby obtaining a printing medium according to the present invention provided with an ink-receiving layer having a dry coating thickness of 30 μm.

The physical properties of the resultant printing medium were determined and evaluated in the same manner as in Example 42. The results are shown in Table 8.

EXAMPLES 44 TO 48

Printing media according to the present invention were obtained in the same manner as in Example 43 except that the polyvinyl butyral-acrylic acid adduct (a) in Example 43 was changed to their corresponding various polymerizable binders shown in Table 7.

The physical properties of the resultant printing media were determined and evaluated in the same manner as in Example 42. The results are shown in Table 8.

TABLE 7

| Ex. | Polymerizable binder | Number average molecular weight | Number of acryloyl groups | Remarks (Points of change, etc.) |
|---|---|---|---|---|
| 44 | Polyvinyl butyral-acrylic acid adduct | 34,400 | (groups/molecule) 110 | Enhanced in coating rate, performed at 200 m/min. |
| 45 | Polyvinyl butyral-acrylic acid adduct | 115,100 | 75 | |
| 46 | Novolak type epoxyacrylate | 3,300 | 10 | Reduced in coating rate, performed at 50 m/min. |
| 47 | Styrene-maleic anhydride copolymer-acrylic acid adduct | 600,000 | 410 | Enhanced in coating rate, performed at 220 m/min. |
| 48 | Reaction product of styrene-methacrylic acid copolymer and glycidyl methacrylate [Structural Formula (f)] | 555,000 | 35 | Reduced in coating rate, performed at 70 m/min. |

REFERENTIAL EXAMPLE 6

A dispersion (solids concentration: 18%) obtained by dispersing the alumina hydrate B treated with the silane coupling agent in Example 42 in ethyl cellosolve and a methyl cellosolve solution (solids concentration: 10%) of polyvinyl butyral ("S-lec BX-1", trade name, molecular weight: 40,200, product of Sekisui Chemical Co., Ltd.) having no polymerizability were weighed out so as to give a weight ratio (P/B ratio) of solid alumina hydrate (P) to solid polyvinyl butyral (B) of 10:1, and the resultant mixture was stirred and then subjected to ball milling for 24 hours, thereby obtaining a mixed dispersion.

Using the same polyester film as that used in Example 42 as a substrate, the mixed dispersion was applied at a coating rate of 150 m/min onto the substrate while subjecting the substrate to a corona discharge treatment, and the thus-coated film was passed through a drying oven of 120° C. to dry it, thereby forming an ink-receiving layer having a dry coating thickness of 30 μm to obtain a printing medium.

The physical properties of the resultant printing medium were determined and evaluated in the same manner as in Example 42. The results are shown in Table 8.

EXAMPLES 49 TO 52 AND REFERENTIAL EXAMPLE 7

The alumina hydrate was treated in the same manner as in Example 42 except that the amount of γ-methacryloxypropyltrimethoxysilane added upon the preparation of the alumina hydrate treated with the coupling agent in Example 42 was changed so as to respectively correspond to those of Examples 2 to 5 and Referential Example 1 shown in Table 2, thereby obtaining respective alumina hydrates treated with the silane coupling agent.

Dispersion, coating, drying and ultraviolet light irradiation were performed in the same manner as in Example 43 to obtain printing media according to the present invention. The physical properties of the resultant printing media were determined and evaluated in the same manner as in Example 42. The results are shown in Table 8.

EXAMPLE 53

The surface treatment with the silane coupling agent was performed in the same manner as in Example 42 except that the alumina hydrate B was changed to the alumina hydrate A, and the preparation of a mixed dispersion, coating, drying and ultraviolet light irradiation were performed in the same manner as in Example 43 to obtain a printing medium according to the present invention. The physical properties of the resultant printing medium were determined and evaluated in the same manner as in Example 42. The results are shown in Table 8.

EXAMPLE 54

The alumina hydrate A was subjected to a surface treatment with a silane coupling agent in the same manner as in Example 42. A dispersion (solids concentration: 18%) obtained by dispersing the thus-treated alumina hydrate in ethyl cellosolve and a liquid having the following composition were weighed out so as to give a weight ratio of the alumina hydrate to polyvinyl acetal and dipentaerythritol hexaacrylate in terms of solids of 10:1.

| | |
|---|---|
| Polyvinyl acetal ("S-lec KS-1", trade name, product of Sekisui Chemical Co., Ltd.) | 1 part |
| Dipentaerythritol hexaacrylate (Kayalad DPHA, trade name, product of Nippon Kayaku Co., Ltd.) | 1 part |
| 2,4-Diethylthioxanthone (Kayacure DETX, trade name, product of Nippon Kayaku Co., Ltd.) | 0.1 part |
| Ethyl 4-dimethylaminobenzoate (Kayacure EPA, trade name, product of Nippon Kayaku Co., Ltd.) | 0.1 part |
| n-Butanol/ethyl cellosolve (weight ratio = 1:1) | 9 parts. |

Thereafter, the preparation of a mixed dispersion, coating, drying and ultraviolet light irradiation were performed in the same manner as in Example 43 to obtain a printing medium according to the present invention. The physical properties of the resultant printing medium were determined and evaluated in the same manner as in Example 42. The results are shown in Table 8.

EXAMPLE 55

Dry Process

The alumina hydrate B (100 parts) was charged into a Henschel mixer. While mixing and stirring the alumina hydrate, a solution obtained by mixing γ-methacryloxypropyltrimethoxysilane (1.12 parts) and xylene (100 parts) was gradually added by spraying in such a manner that a proportion of an area covered with the coupling agent by the surface treatment amounted to 1.5%. After completion of the addition, the thus-treated alumina hydrate was heated to 75° C., thereby volatilizing xylene alone to recover it. The alumina hydrate was further heated at 120° C. for 3 hours to dry it, thereby obtaining an alumina hydrate treated with the silane coupling agent.

Thereafter, dispersion, coating, drying and ultraviolet light irradiation were performed in the same manner as in Example 43 to obtain a printing medium according to the present invention. The physical properties of the resultant printing medium were determined and evaluated in the same manner as in Example 42. The results are shown in Table 8.

EXAMPLE 56

Integral Blending

A dispersion was prepared in the same manner as in Example 43 except that the alumina hydrate B treated with the coupling agent was changed to the untreated alumina hydrate B, and a methyl cellosolve solution containing γ-methacryloxypropyltrimethoxysilane (1.12 parts) was added, and coating, drying and ultraviolet light irradiation were performed in the same manner as in Example 43 to obtain a printing medium according to the present invention. The physical properties of the resultant printing medium were determined and evaluated in the same manner as in Example 42. The results are shown in Table 8.

EXAMPLES 57 TO 65

In a similar manner to Example 42, the alumina hydrates A and B were treated with coupling agents shown in Table 3 in their corresponding combinations and amounts to be added shown in Table 8, thereby obtaining alumina hydrates treated with the respective coupling agents. Using these alumina hydrates, dispersion, coating, drying and ultraviolet light irradiation were performed in the same manner as in Example 43 to obtain printing media according to the present invention. The physical properties of the resultant printing media were determined and evaluated in the same manner as in Example 42. The results are shown in Table 8.

Besides the transparent polyester film (TP), resin-coated paper (product of Shin-Oji Paper Co., Ltd., thickness: 180 μm; "RC") and a white polyester film (Lumirror X-21, product of Toray Industries, Inc., thickness: 100 μm; "WP") were also used as substrates.

EXAMPLE 66

Dispersion, coating, drying and ultraviolet light irradiation were performed in the same manner as in Example 45 except that silica [colloidal silica, Snowtex IPA-ST (trade name, a 30% by weight dispersion in isopropanol), product of Nissan Chemical Industries, Ltd.] was used in addition to the alumina hydrate treated with the silane coupling agent used in Example 43 so as to give a weight ratio of the alumina hydrate to the silica in terms of solids of 8:2, thereby obtaining a printing medium according to the present invention. The physical properties of the resultant printing medium were determined and evaluated in the same manner as in Example 42. The results are shown in Table 8.

REFERENTIAL EXAMPLE 8

A dispersion (solids concentration: 18%) obtained by dispersing the alumina hydrate B treated with no coupling agent in deionized water and an aqueous solution (solids concentration 10%) obtained by dissolving polyvinyl alcohol (Gohsenol NH-18, trade name, product of The Nippon Synthetic Chemical Industry Co., Ltd.) in deionized water were weighed out so as to give a weight ratio in terms of solids (P/B ratio) of 10:1, and the resultant mixture was subjected to ball milling for 24 hours, thereby obtaining a mixed dispersion (solids concentration: 15%).

The mixed dispersion was applied at a coating rate of 10 m/min onto a substrate, and the thus-coated substrate was passed through a drying oven of 120° C. to dry it, thereby forming an ink-receiving layer having a dry coating thickness of 30 $\mu$m to obtain a printing medium. The physical properties of the resultant printing medium were determined and evaluated in the same manner as in Example 42. The results are shown in Table 8.

REFERENTIAL EXAMPLE 9

A printing medium was obtained in the same manner as in Referential Example 8 except that the coating rate in Referential Example 5 was changed to 50 m/min. The physical properties of the resultant printing medium were determined and evaluated in the same manner as in Example 42. The results are shown in Table 8.

The determining and evaluating methods used in Examples 42 to 66 and Referential Examples 4 to 6 are as follows.

The physical properties of the dispersions and ink-receiving layers were determined and evaluated in the same manner as in the evaluating and determining method 1 of physical properties of dispersion and the evaluating and determining method 1 of physical properties of ink-receiving layer. However, the evaluation of the ink-receiving layers as to surface hardness was added.

6) Surface Hardness:

(1) Pencil hardness: A pencil hardness of the surface of each ink-receiving layer was measured in accordance with JIS K 5400. However, a load was changed from 1 kg to 500 g.

(2) Scratching by a ball point pen: The surface of each ink-receiving layer was rubbed with a capped ball point pen (BP-P, black, product of Pilot Pen Co., Ltd.) to such a degree that a drawing was made, and the resistance to scratching was determined by visually observing the surface and ranked as A where the surface was not scratched, or C where the surface was scratched.

TABLE 8

| Example | 42 | 43 | 44 | 45 | 46 | 47 | 48 | Ref. 6 | 49 | 50 | 51 |
|---|---|---|---|---|---|---|---|---|---|---|---|
| Alumina hydrate | B | B | B | B | B | B | B | B | B | B | B |
| Coupling agent | 1 | 1 | 1 | 1 | 1 | 1 | 1 | 1 | 1 | 1 | 1 |
| Proportion of covered area (%) | 1.5 | 1.5 | 1.5 | 1.5 | 1.5 | 1.5 | 1.5 | 1.5 | 1.5 | 1.5 | 1.5 |
| Dispersing state | A | AA | AA | AA | A | A | A | AA | A | AA | AA |
| Substrate | TP | TP | TP | TP | TP | TP | TP | TP | TP | TP | TP |
| Coating rate (m/min) | 300 | 150 | 200 | 150 | 50 | 220 | 70 | 150 | 150 | 150 | 150 |
| Coating of ink-receiving layer | A | A | A | A | A | A | A | A | A | A | A |
| Glossiness | — | — | — | — | — | — | — | — | — | — | — |
| Surface hardness (1) | 2H–3H | 2H–3H | 3H | 2H–3H | H | 2H–3H | 2H | F | 2H–3H | 2H–3H | 2H–3H |
| Surface hardness (2) | A | A | A | A | A | A | A | C | A | A | A |
| Ink absorbency | AA | AA | AA | AA | AA | AA | AA | AA | AA | AA | AA |
| Optical density | — | — | — | — | — | — | — | — | — | — | — |
| Beading | AA | AA | AA | AA | AA | AA | AA | AA | AA | AA | AA |
| Water fastness | AA | AA | AA | AA | AA | AA | AA | AA | AA | AA | AA |

| Example | 52 | Ref. 7 | 53 | 54 | 55 | 56 | 57 | 58 | 59 | 60 |
|---|---|---|---|---|---|---|---|---|---|---|
| Alumina hydrate | B | B | A | A | B | B | A | B | A | A |
| Coupling agent | 1 | 1 | 1 | 1 | 1 | 1 | 2 | 3 | 4 | 5 |
| Proportion of covered area (%) | 30.0 | 45 | 1.5 | 1.5 | 1.5 | 1.5 | 3.0 | 5.0 | 2.0 | 2.0 |
| Dispersing state | AA | AA | AA | AA | AA | A | AA | AA | AA | AA |
| Substrate | TP | TP | TP | TP | TP | TP | RC | RC | RC | WP |
| Coating rate (m/min) | 150 | 150 | 150 | 100 | 150 | 150 | 150 | 150 | 150 | 150 |
| Coating of ink-receiving layer | A | A | A | A | A | A | A | A | A | A |
| Glossiness | — | — | — | — | — | — | 61.7 | 63.0 | 62.0 | 62.8 |
| Surface hardness (1) | 2H–3H | 2H–3H | 2H–3H | 2H–3H | 2H–3H | 2H–3H | 2H–3H | 2H–3H | 2H–3H | 2H–3H |
| Surface hardness (2) | A | A | A | A | A | A | A | A | A | A |
| Ink absorbency | A | B | AA | AA | AA | AA | AA | AA | AA | AA |
| Optical density | — | — | — | — | — | — | 1.75 | 1.77 | 1.75 | 1.80 |
| Beading | AA | A | AA | AA | AA | AA | AA | AA | AA | AA |
| Water fastness | AA | AA | AA | AA | AA | AA | AA | AA | AA | AA |

| Example | 61 | 62 | 63 | 64 | 65 | 66 | Ref. 8 | Ref. 9 |
|---|---|---|---|---|---|---|---|---|
| Alumina hydrate | A | B | A | B | A | B | B | B |
| Coupling agent | 6 | 7 | 8 | 9 | 10 | 1 | — | — |
| Proportion of covered area (%) | 2.0 | 1.0 | 1.0 | 1.5 | 1.5 | 1.5 | 0 | 0 |
| Dispersing state | AA | AA | AA | AA | AA | A | AA | AA |
| Substrate | WP | TP | RC | TP | TP | TP | TP | TP |
| Coating rate (m/min) | 150 | 150 | 150 | 150 | 150 | 150 | 10 | 50 |

TABLE 8-continued

| | | | | | | | | |
|---|---|---|---|---|---|---|---|---|
| Coating of ink-receiving layer | A | A | A | A | A | A*1 | A | C*2 |
| Glossiness | 61.8 | 62.9 | 61.9 | 62.5 | 62.0 | 53.5 | — | — |
| Surface hardness (1) | 2H–3H | 2H–3H | 2H–3H | 2H–3H | 2H–3H | H | F–H | ≦HB |
| Surface hardness (2) | A | A | A | A | A | A | C | C |
| Ink absorbency | AA | AA | AA | AA | AA | AA | AA | B |
| Optical density | 1.75 | 1.79 | 1.75 | 1.81 | 1.77 | — | — | — |
| Beading | AA | AA | AA | AA | AA | AA | A | B |
| Water fastness | AA | AA | AA | AA | AA | A | A | B |

*1Somewhat rough surface.
*2Undry.

As described above, the present invention has the following advantageous effects.

1) There can be provided a production process of a printing medium, by which the degree of freedom of a dispersion medium is wide, a dispersion is stable, margins for the preparation conditions, coating conditions and drying conditions of the dispersion are wide, the dispersion can be applied at high speed, and productivity is high.

2) There can be provided a printing medium which has high surface evenness, transparency, gloss and ink absorbency, and can provide an image having high optical density, resolution and water fastness. When resin-coated paper is used as a substrate in particular, a printing medium having the same feeling to the touch, stiffness and texture as those of a usual photoprint can be provided.

3) The surface hardness of an ink-receiving layer is improved, so that a printing medium hard to be scratched can be provided.

In particular, in the case where a coating dispersion is of an aqueous system, 4) there can be provided a printing medium which has a transparent ink-receiving layer, can provide an image high in optical density and resolution and bright in color tone, and scarcely causes beading and bleeding even under severe environmental conditions to provide a high-quality image having high weather fastness.

5) There can be provided a printing medium produced with a coating dispersion which has high dispersion stability, scarcely undergoes increase in viscosity with time even at a high solids concentration, is hard to crack and can be coated into a thick layer, having high productivity and permitting the provision of a high-quality image.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. A process for producing a printing medium comprising forming an ink-receiving layer on a substrate, wherein the ink-receiving layer is formed by applying a dispersion comprising a coupling agent or a hydrolyzate thereof, an alumina hydrate, a binder and water to the substrate and then drying the dispersion to make the alumina hydrate hydrophobic.

2. A process for producing a printing medium comprising forming an ink-receiving layer on a substrate, wherein the ink-receiving layer is formed by applying a dispersion comprising an alumina hydrate surface-treated with a coupling agent to make the alumina hydrate hydrophobic in advance and a polymerizable compound to the substrate and then polymerizing the polymerizable compound.

3. The process according to claim 1 or 2, wherein the coupling agent is selected from the group consisting of silane, titanate, aluminum and zirconium coupling agents.

4. The process according to claim 1 or 2, wherein the proportion of the area covered with the coupling agent by the surface treatment of the alumina hydrate amounts to 0.1 to 30%.

5. The process according to claim 1 or 2, wherein the proportion of the area covered with the coupling agent by the surface treatment of the alumina hydrate amounts to 0.5 to 20%.

6. The process according to claim 1 or 2, wherein the proportion of the area covered with the coupling agent by the surface treatment of the alumina hydrate amounts to 0.7 to 15%.

7. The process according to claim 1 or 2, wherein the pore volume of the alumina hydrate falls within a range of from 0.1 to 1.0 ml/g.

8. The process according to claim 1 or 2, wherein the BET specific surface area of the alumina hydrate falls within a range of from 40 to 500 $m^2/g$.

9. The process according to claim 1 or 2, wherein the pore volume of the ink-receiving layer falls within a range of from 0.1 to 1.0 ml/g.

10. The process according to claim 1 or 2, wherein the BET specific surface area of the ink-receiving layer falls within a range of from 40 to 450 $m^2/g$.

11. The process according to claim 1 or 2, wherein the mixing ratio by weight of the alumina hydrate to the binder falls within the range of from 1:1 to 30:1.

12. The process according to claim 1 or 2, wherein the mixing ratio by weight of the alumina hydrate to the binder falls within the range of from 5:1 to 20:1.

13. The process according to claim 2, wherein the polymerizable compound is a polymerizable binder having film-forming properties prior to its polymerization and containing polymerizable functional groups in a proportion of from 10 to 700 groups per molecule.

14. The process according to claim 13, wherein the polymerizable binder has tensile strength prior to its polymerization within a range of from 10 to 800 $kg/cm^2$ as measured in accordance with ASTM D 638.

15. The process according to claim 2, wherein the polymerizable binder has a molecular weight within a range of from 10,000 to 600,000 prior toits polymerization.

16. The process according to claim 2, wherein the dispersion contains a polymerization initiator.

* * * * *

UNITED STATES PATENT AND TRADEMARK OFFICE

CERTIFICATE OF CORRECTION

PATENT NO. : 6,558,740 B1
DATED : May 6, 2003
INVENTOR(S) : Tsuyoshi Santo et al.

It is certified that error appears in the above-identified patent and that said Letters Patent is hereby corrected as shown below:

Title page,
Item [56], References Cited, FOREIGN PATENT DOCUMENTS,
"JP 57-89954 6/1992" should read -- JP 57-89954 6/1982 --.

Column 4,
Line 21, "use.an" should read -- use an --.

Column 8,
Line 11, "or-decomposition" should read -- or decomposition --.
Line 40, "and-hydrolysis" should read -- and hydrolysis --.

Column 15,
Line 5, "homopolyners" should read -- homopolymers --.

Column 24,
Line 19, "coating-were" should read -- coating were --.

Column 42,
Line 59, "toits" should read -- to its --.

Signed and Sealed this

Twenty-seventh Day of April, 2004

JON W. DUDAS
*Acting Director of the United States Patent and Trademark Office*